US009074546B2

(12) United States Patent
Asami et al.

(10) Patent No.: US 9,074,546 B2
(45) Date of Patent: Jul. 7, 2015

(54) WORK VEHICLE AND WORK VEHICLE CONTROL METHOD

(75) Inventors: Satoshi Asami, Hiratsuka (JP); Jun Koizumi, Hadano (JP); Shotaro Ishii, Sagamihara (JP); Takahisa Oasa, Hiratsuka (JP); Ai Haginiwa, Hiratsuka (JP); Masahiro Minato, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 103 days.

(21) Appl. No.: 13/583,189

(22) PCT Filed: Feb. 16, 2011

(86) PCT No.: PCT/JP2011/053203

§ 371 (c)(1),
(2), (4) Date: Sep. 6, 2012

(87) PCT Pub. No.: WO2011/138880

PCT Pub. Date: Nov. 10, 2011

(65) Prior Publication Data

US 2013/0041561 A1 Feb. 14, 2013

(30) Foreign Application Priority Data

May 7, 2010 (JP) ..... 2010-107115

(51) Int. Cl.
*E02F 9/20* (2006.01)
*F02D 41/14* (2006.01)
(Continued)

(52) U.S. Cl.
CPC ..... *F02D 41/1497* (2013.01); *E02F 9/2246* (2013.01); *E02F 9/2253* (2013.01);
(Continued)

(58) Field of Classification Search
CPC ..... B60W 2300/17; B60W 2510/0638; B60W 2520/28; B60W 30/1884; B60W 30/1888; B60W 50/085; B60W 50/35
USPC ..... 701/50, 51, 54, 56, 67, 84, 91; 477/68, 477/69, 110, 111, 115
See application file for complete search history.

(56) References Cited

U.S. PATENT DOCUMENTS 8,316,983 B2 * 11/2012 Shirao ..... 180/305
8,504,257 B2 * 8/2013 Yamaguchi et al. ..... 701/50
(Continued)

FOREIGN PATENT DOCUMENTS

CN 1846047 A 10/2006
JP 61-110625 A 5/1986
(Continued)

OTHER PUBLICATIONS

International Search Report of corresponding PCT Application No. PCTI2011/053203.
(Continued)

*Primary Examiner* — John R Olszewski
*Assistant Examiner* — Truc M Do
(74) *Attorney, Agent, or Firm* — Global IP Counselors, LLP

(57) ABSTRACT

A work vehicle includes a controller. The controller is configured to determine whether low-load conditions indicating that the work vehicle is in a low-load state are satisfied. The controller is configured to control an engine so that an upper limit value of an output torque of the engine when the low-load conditions are satisfied is made less than when the low-load conditions are not satisfied. Also, the controller is configured to vary a reduction amount of the upper limit value of the output torque of the engine when the low-load conditions are satisfied, in accordance with variation in at least one of vehicle speed, vehicle acceleration, and engine-rotation-speed acceleration, and in accordance with variation in engine rotation speed.

10 Claims, 16 Drawing Sheets

(51) Int. Cl.
*E02F 9/22* (2006.01)
*F02D 29/02* (2006.01)
*E02F 9/08* (2006.01)

(52) U.S. Cl.
CPC ..... *F02D 29/02* (2013.01); *F02D 2200/1012* (2013.01); *F02D 2200/501* (2013.01); *F02D 2250/18* (2013.01); *F02D 2250/26* (2013.01); *E02F 9/0841* (2013.01); *E02F 9/2066* (2013.01); *E02F 9/225* (2013.01); *E02F 9/2292* (2013.01)

(56) References Cited

U.S. PATENT DOCUMENTS

| | | | | |
|---|---|---|---|---|
| 8,532,888 | B2 * | 9/2013 | Ishibashi et al. | 701/51 |
| 8,666,610 | B2 * | 3/2014 | Shirao | 701/50 |
| 8,706,364 | B2 * | 4/2014 | Shirao | 701/50 |
| 2005/0071067 | A1 * | 3/2005 | Guven et al. | 701/54 |
| 2006/0172853 | A1 * | 8/2006 | Ishibashi et al. | 477/52 |
| 2006/0276948 | A1 * | 12/2006 | Toda | 701/50 |
| 2007/0287589 | A1 * | 12/2007 | Kadono et al. | 477/110 |
| 2008/0269011 | A1 * | 10/2008 | Sopko et al. | 477/34 |
| 2009/0120175 | A1 * | 5/2009 | Assaf et al. | 73/114.12 |
| 2009/0223215 | A1 * | 9/2009 | Kelly et al. | 60/426 |
| 2009/0247356 | A1 * | 10/2009 | Hatanaka | 477/64 |
| 2009/0320461 | A1 * | 12/2009 | Morinaga et al. | 60/431 |
| 2010/0089051 | A1 * | 4/2010 | Ohtsukasa | 60/451 |
| 2010/0106382 | A1 * | 4/2010 | Kodaka et al. | 701/54 |
| 2010/0138118 | A1 * | 6/2010 | Tsukada et al. | 701/50 |
| 2010/0167873 | A1 * | 7/2010 | Akiyama et al. | 477/68 |
| 2010/0186402 | A1 * | 7/2010 | Ariga et al. | 60/329 |
| 2010/0317486 | A1 * | 12/2010 | Hyodo et al. | 477/52 |
| 2010/0324788 | A1 * | 12/2010 | Toda | 701/50 |
| 2011/0231070 | A1 | 9/2011 | Toda | |
| 2011/0276238 | A1 | 11/2011 | Toda | |
| 2013/0118160 | A1 * | 5/2013 | Toda | 60/459 |

FOREIGN PATENT DOCUMENTS

| | | | |
|---|---|---|---|
| JP | 11-293710 | A | 10/1999 |
| JP | 11-293710 | A | 10/1999 |
| JP | 2001-352612 | A | 12/2001 |
| JP | 2002-54475 | A | 2/2002 |
| JP | 2009-156173 | A | 7/2009 |
| JP | 2011-236759 | A | 11/2011 |
| WO | WO-2005/024208 | A1 | 3/2005 |
| WO | WO-2011/138880 | A1 | 11/2011 |

OTHER PUBLICATIONS

The Office Action for the corresponding Chinese application No. 201180022882.6, issued on Oct. 8, 2014.

* cited by examiner

| ACCELERATOR OPERATION AMOUNT [%] | 0 | 10 | 20 | 30 | 40 | 50 | 60 | 70 | 80 | 90 | 100 |
|---|---|---|---|---|---|---|---|---|---|---|---|
| Nbp [rpm] | n0 | n1 | n2 | n3 | n4 | n5 | n6 | n7 | n8 | n9 | n10 |

| LOW-LOAD CONDITIONS | SELECTED TABLE |
|---|---|
| "CARGO-LOADED FORWARD + BUCKET OPERATION MEMBER AND DUMP OPERATION AMOUNT 50% OR MORE"<br>OR<br>"CARGO-LOADED STOP + BUCKET OPERATION MEMBER AND DUMP OPERATION AMOUNT 50% OR MORE" | DUMP TABLE |
| SHUTTLE | SHUTTLE TABLE |
| NO-CARGO FORWARD | NO-CARGO FORWARD TABLE |
| NO-CARGO REVERSE | NO-CARGO REVERSE TABLE |
| CARGO-LOADED FORWARD + POSITION OF THE GEAR SHIFT OPERATION MEMBER IS SECOND SPEED | CARGO-LOADED FORWARD TABLE |
| CARGO-LOADED REVERSE | CARGO-LOADED REVERSE TABLE |

FIG. 6

(a)

| TORQUE REDUCTION AMOUNT | | VEHICLE SPEED [km/h] | | | | | |
|---|---|---|---|---|---|---|---|
| | | V0 | V1 | V2 | V3 | V4 | Vmax |
| ENGINE ROTATION SPEED | N11 | 0 | 0 | 0 | 0 | 0 | 0 |
| | N12 | 0 | 0 | 0 | a111 | a112 | a112 |
| | N13 | 0 | 0 | 0 | a121 | a122 | a122 |
| | N14 | 0 | 0 | 0 | a121 | a122 | a122 |
| | N15 | 0 | 0 | 0 | a121 | a122 | a122 |
| | N16 | 0 | 0 | 0 | a121 | a122 | a122 |

(b)

| TORQUE REDUCTION AMOUNT | | VEHICLE SPEED [km/h] | | | | | |
|---|---|---|---|---|---|---|---|
| | | V0 | V1 | V2 | V3 | V4 | Vmax |
| ENGINE ROTATION SPEED | N21 | 0 | 0 | 0 | 0 | 0 | 0 |
| | N12 | 0 | b111 | b112 | b113 | b113 | 0 |
| | N13 | 0 | b121 | b122 | b122 | b122 | 0 |
| | N14 | 0 | b131 | b132 | b132 | b132 | 0 |
| | N15 | 0 | b141 | b142 | b142 | b142 | 0 |
| | N16 | 0 | b151 | b152 | b152 | b152 | 0 |

(c)

| TORQUE REDUCTION AMOUNT | | VEHICLE SPEED [km/h] | | | | | |
|---|---|---|---|---|---|---|---|
| | | V0 | V1 | V2 | V3 | V4 | Vmax |
| ENGINE ROTATION SPEED | N31 | 0 | 0 | 0 | 0 | 0 | 0 |
| | N12 | 0 | c111 | c112 | c111 | 0 | 0 |
| | N13 | 0 | c121 | c122 | c121 | 0 | 0 |
| | N14 | 0 | c131 | c131 | c131 | 0 | 0 |
| | N15 | 0 | c141 | c141 | c141 | 0 | 0 |
| | N16 | 0 | c151 | c151 | c151 | 0 | 0 |

FIG. 8

(a)
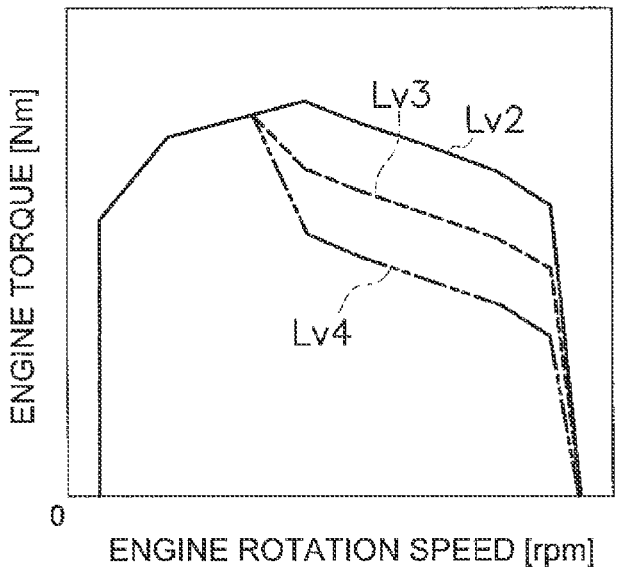
(b)
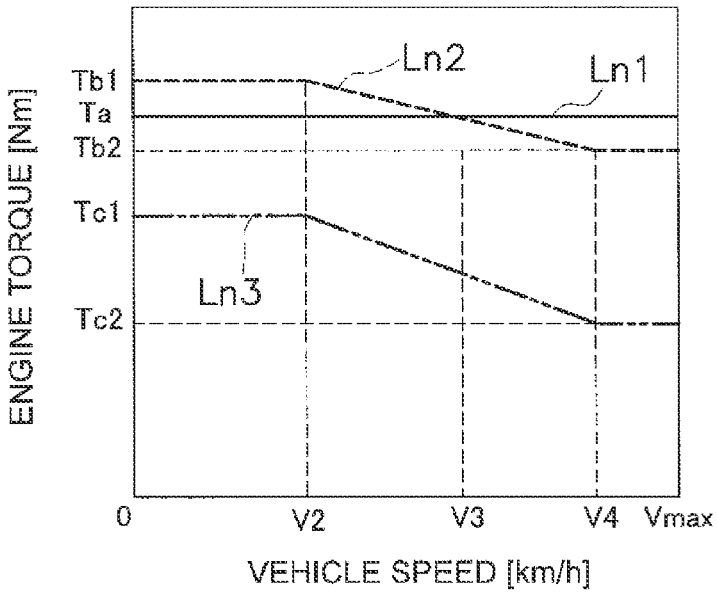
FIG. 10

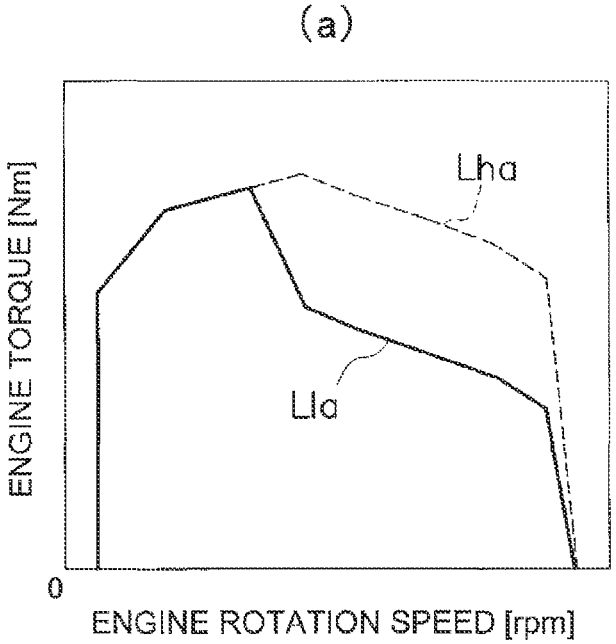
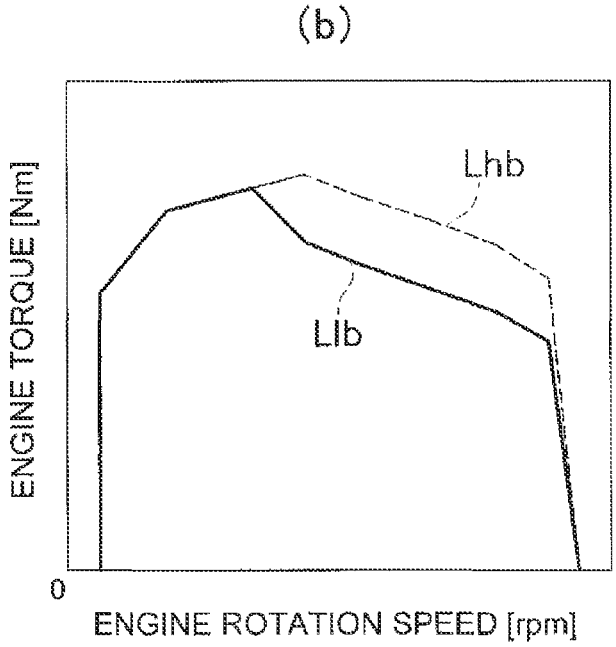
FIG. 11

FIG. 12
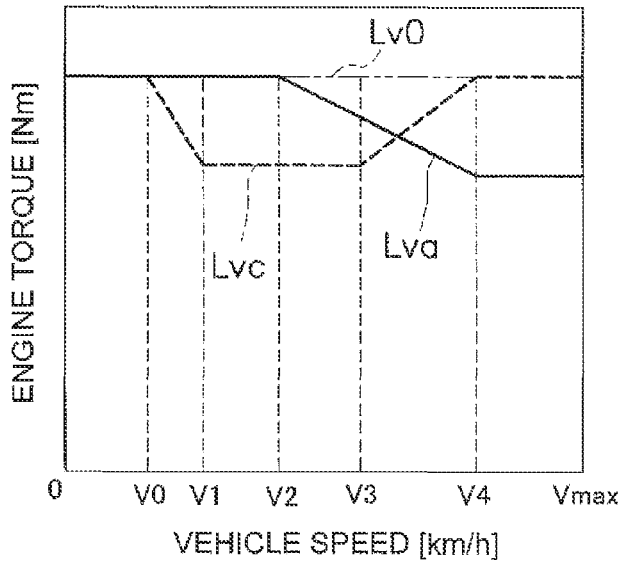
FIG. 13
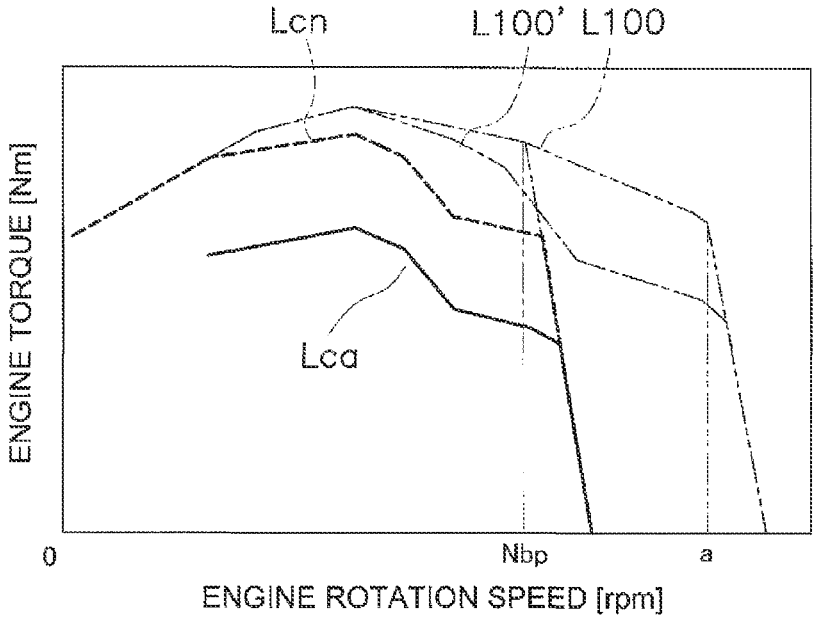
FIG. 14
| ACCELERATOR OPERATION AMOUNT [%] | a1 | a2 | a3 | a4 | a5 | a6 | a7 |
|---|---|---|---|---|---|---|---|
| TORQUE REDUCTION CORRECTION VALUE (B) [Nm] | b1 | b1 | b2 | b3 | b4 | b5 | 0 |

(a)

REDUCTION RATIO CALCULATION TABLE BY ACCELERATOR OPERATION AMOUNT

| ACCELERATOR OPERATION AMOUNT [%] | AC1 | AC2 |
|---|---|---|
| REDUCTION RATIO (ra) | 0 | 1 |

(b)

REDUCTION RATIO CALCULATION TABLE BY VEHICLE SPEED

| VEHICLE SPEED [km/h] | VL1 | VL2 |
|---|---|---|
| REDUCTION RATIO (rv) | 0 | 1 |

(a)

| TORQUE REDUCTION AMOUNT | | VEHICLE ACCELERATION (m/s²) | | | | | |
|---|---|---|---|---|---|---|---|
| | | 0 | VA1 | VA2 | VA3 | VA4 | VAmax |
| ENGINE ROTATION SPEED | N21 | 0 | 0 | 0 | 0 | 0 | 0 |
| | N22 | 0 | 0 | 0 | a211 | a212 | a213 |
| | N23 | 0 | 0 | 0 | a221 | a222 | a223 |
| | N24 | 0 | 0 | 0 | a231 | a232 | a233 |
| | N25 | 0 | 0 | 0 | a241 | a242 | a243 |
| | N26 | 0 | 0 | 0 | a251 | a252 | a253 |

(b)

| TORQUE REDUCTION AMOUNT | | VEHICLE ACCELERATION (m/s²) | | | | | |
|---|---|---|---|---|---|---|---|
| | | 0 | VA1 | VA2 | VA3 | VA4 | VAmax |
| ENGINE ROTATION SPEED | N21 | 0 | 0 | 0 | 0 | 0 | 0 |
| | N22 | 0 | b211 | b212 | b213 | b214 | b215 |
| | N23 | 0 | b221 | b222 | b223 | b224 | b225 |
| | N24 | 0 | b231 | b232 | b233 | b234 | b235 |
| | N25 | 0 | b241 | b242 | b243 | b244 | b245 |
| | N26 | 0 | b251 | b252 | b253 | b254 | b255 |

(c)

| TORQUE REDUCTION AMOUNT | | VEHICLE ACCELERATION (m/s²) | | | | | |
|---|---|---|---|---|---|---|---|
| | | 0 | VA1 | VA2 | VA3 | VA4 | VAmax |
| ENGINE ROTATION SPEED | N21 | 0 | 0 | 0 | 0 | 0 | 0 |
| | N22 | 0 | c211 | c212 | c213 | c214 | c215 |
| | N23 | 0 | c221 | c222 | c223 | c224 | c225 |
| | N24 | 0 | c231 | c232 | c233 | c234 | c235 |
| | N25 | 0 | c241 | c242 | c243 | c244 | c245 |
| | N26 | 0 | c251 | c252 | c253 | c254 | c255 |

FIG. 17

(a)

| TORQUE REDUCTION AMOUNT | | ACCELERATION OF ENGINE SPEED ($min^{-2}$) | | | | | |
|---|---|---|---|---|---|---|---|
| | | 0 | EA1 | EA2 | EA3 | EA4 | EAmax |
| ENGINE ROTATION SPEED | N31 | 0 | 0 | 0 | 0 | 0 | 0 |
| | N32 | 0 | 0 | 0 | a311 | a312 | a313 |
| | N33 | 0 | 0 | 0 | a321 | a322 | a323 |
| | N34 | 0 | 0 | 0 | a331 | a332 | a333 |
| | N35 | 0 | 0 | 0 | a341 | a342 | a343 |
| | N36 | 0 | 0 | 0 | a351 | a352 | a353 |

(b)

| TORQUE REDUCTION AMOUNT | | ACCELERATION OF ENGINE SPEED ($min^{-2}$) | | | | | |
|---|---|---|---|---|---|---|---|
| | | 0 | EA1 | EA2 | EA3 | EA4 | EAmax |
| ENGINE ROTATION SPEED | N31 | 0 | 0 | 0 | 0 | 0 | 0 |
| | N32 | 0 | b311 | b312 | b313 | b314 | b315 |
| | N33 | 0 | b321 | b322 | b323 | b324 | b325 |
| | N34 | 0 | b331 | b332 | b333 | b334 | b335 |
| | N35 | 0 | b341 | b342 | b343 | b344 | b345 |
| | N36 | 0 | b351 | b352 | b353 | b354 | b355 |

(c)

| TORQUE REDUCTION AMOUNT | | ACCELERATION OF ENGINE SPEED ($min^{-2}$) | | | | | |
|---|---|---|---|---|---|---|---|
| | | 0 | EA1 | EA2 | EA3 | EA4 | EAmax |
| ENGINE ROTATION SPEED | N31 | 0 | 0 | 0 | 0 | 0 | 0 |
| | N32 | 0 | c311 | c312 | c313 | c314 | c315 |
| | N33 | 0 | c321 | c322 | c323 | c324 | c325 |
| | N34 | 0 | c331 | c332 | c333 | c334 | c335 |
| | N35 | 0 | c341 | c342 | c343 | c344 | c345 |
| | N36 | 0 | c351 | c352 | c353 | c354 | c355 |

FIG. 18

WORK VEHICLE AND WORK VEHICLE CONTROL METHOD

CROSS-REFERENCE TO RELATED APPLICATIONS

This application claims priority to Japanese Patent Application No. 2010-10711.5 filed on May 7, 2010, the disclosure of which is hereby incorporated herein by reference in its entirety.

TECHNICAL HELD

The present invention relates to a work vehicle and a work vehicle control method.

BACKGROUND AU

In a wheel loader or other work vehicle, there is a conventionally known technique for switching a control mode for controlling engine output to a low-output mode and a high-output mode in accordance with the work load (see International Patent Publication No. WO2005-024208). In each control mode, the output of the engine is controlled in accordance with an engine torque curve set in advance. The engine torque curve shows the relationship between the engine rotation speed and the upper limit value of the engine output torque. In relation to the upper limit value of the output torque of the engine, the engine torque curve in the low-output mode is set to be a magnitude of $\alpha$ ($\alpha<1$) of the engine torque curve of the high-output mode.

SUMMARY

Technical Problem

In the above-described technique, when the work load is reduced, a switch is made from the engine torque curve of the high-output mode to the engine torque curve of the low-output mode. However, the engine torque curve of the low-output mode is a completely different engine torque curve in which the upper limit value of the engine output torque is a magnitude of a in relation to the engine torque curve of the high-output mode. Accordingly, the output performance of the engine is liable to vary rapidly during work. In this case, the ease of operation of the work vehicle is reduced.

In order to prevent a reduction in ease of operation such as that described above, it is possible to consider reducing the torque difference between the engine torque curve in the low-output mode and the engine torque curve in the high-output mode. Rapid variation in the engine torque can thereby be inhibited. However, in this case, the amount of reduction in the output torque of the engine in the low-output mode is reduced. Accordingly, the effect of reduced fuel consumption is lessened.

An object of the present invention is to provide a work vehicle and a work vehicle control method that inhibits a reduction in ease of operation and that can improve the effect of reduced fuel consumption.

Solution to Problem

The work vehicle according to a first aspect of the present invention comprises an engine, a travel device, a work implement, a first detector, a second detector, and a controller. The travel device causes the vehicle to travel by drive force from the engine. The work implement is driven by drive force from the engine. The first detector detects engine rotation speed. The second detector detects at least one among vehicle speed, vehicle acceleration, and engine-rotation-speed acceleration. The controller determines whether low-load conditions that show that a vehicle is in a low-load state have been satisfied. The controller controls the engine so that, when the low-load conditions are satisfied, the upper limit value of the output torque of the engine is made less than when the low-load conditions are not satisfied. Also, the controller varies the reduction amount of the upper limit value of the output torque of the engine when the low-load conditions are satisfied, in accordance with at least one among the vehicle speed, the vehicle acceleration, and the engine-rotation-speed acceleration detected by the second detector, and in accordance with variation in the engine rotation speed detected by the first detector.

In this work vehicle, when the low-load conditions are satisfied, the upper limit value of the output torque of the engine is made less than when the low-load conditions are not satisfied. Fuel consumption is thereby reduced. The reduction amount of the upper limit value of the output torque of the engine when the low-load conditions are satisfied vary in accordance with the variation in the engine rotation speed and at least one of the vehicle speed, the vehicle acceleration, and the engine-rotation-speed acceleration. Therefore, the upper limit value of the output torque of the engine is not reduced uniformly by an amount set in advance, but the reduction amount is varied in accordance with the variation in the state of the engine rotation speed, the vehicle speed, and the like. Accordingly, rapid changes in the output torque of the engine are inhibited. In this way, a reduction in the ease of operation is inhibited.

The work vehicle according to a second aspect of the present invention is the work vehicle according to the first aspect, wherein the reduction amount varies in accordance with the low-load conditions.

When the low-load conditions differ, the magnitude of the load imposed on the vehicle also differs. Accordingly, the reduction amount is varied in accordance with the low-load conditions, whereby a reduction amount suitable for the magnitude of the load can be determined. For example, low-load conditions with a high load, the reduction amount can be made less than low-load conditions with a low load, even when the low-load conditions are satisfied. In this way, a reduction in the ease of operation can be further inhibited.

The work vehicle according to a third aspect of the present invention is the work vehicle according to the first aspect, wherein the controller reduces the upper limit value of the output torque of the engine when the engine rotation speed is greater than a predetermined speed. Also, the predetermined engine speed varies in accordance with the low-load conditions.

In this work vehicle, the upper limit value of the output torque of the engine is reduced when the engine rotation speed is greater than a predetermined speed. In other words, when the engine rotation speed is less than a predetermined speed, the upper limit value of the output torque of the engine is not reduced, even when the low-load conditions are satisfied. In this way, it is possible to inhibit an excessive reduction in the output torque of the engine. Also, the predetermined engine speed varies in accordance with the low-load conditions. Since the minimum required output torque of the engine differs in accordance with the low-load conditions, the predetermined engine speed is varied in accordance with the low-load conditions, whereby the minimum required output torque of the engine can be ensured for each low-load condition. Fuel consumption can thereby be improved while a reduction in ease of operation is inhibited.

The work vehicle according to a fourth aspect of the present invention is the work vehicle according to the first aspect, further comprising: an accelerator operation member operated by an operator; and a third detector for detecting the operation amount of the accelerator operation member. The controller determines the reduction amount with consideration given to the operation amount of the accelerator operation member detected by the third detector.

In this work vehicle, the reduction amount of the upper limit value of the output torque of the engine is determined with consideration given to the operation amount of the accelerator operation member. Accordingly, the intent of the operator can be reflected in the reduction amount. Ease of operation can thereby be improved.

The work vehicle according to a fifth aspect of the present invention is the work vehicle according to any of the first to fourth aspects, wherein the second detector detects the vehicle speed. When the vehicle speed is equal to or greater than a predetermined speed, the controller reduces the reduction amount to be less than when the vehicle speed is less than the predetermined speed.

In this work vehicle, the output torque of the engine can be inhibited from being excessively reduced during high-speed travel. In this way, it is possible to inhibit a reduction in travel performance during high-speed travel.

The work vehicle according to a sixth aspect of the present invention is the work vehicle according to the any of the first to fourth aspects, wherein the second detector detects the vehicle speed. When the vehicle speed is less than a first predetermined speed, and when the vehicle speed is greater than a second predetermined speed that is greater than the first predetermined speed, the controller reduces the reduction amount to be less than when the vehicle speed is equal to or greater the first predetermined speed and equal to or less than the second predetermined speed.

In this work vehicle, it is possible to inhibit an excessive reduction in the output torque of the engine during low-speed travel and during high-speed travel. In this way, it is possible to inhibit a reduction in travel performance during low-speed travel and during high-speed travel.

The work vehicle according to a seventh aspect of the present invention is the work vehicle according to the first aspect, wherein the controller determines a work phase of the vehicle from an operating state of the travel device and the work implement, and determines whether the low-load conditions are satisfied on the basis of the work phase.

In this work vehicle, the reduction amount of the upper limit value of the output torque of the engine is determined on the basis of the work phase. Accordingly, a suitable reduction amount can be determined by the load state of the vehicle. In this way, it is further possible to reduce fuel consumption and to inhibit a reduction in ease of operation.

The work vehicle according to an eighth aspect of the present invention is the work vehicle according to the seventh aspect, wherein the low-load conditions include that the work phase is a no-cargo state. The no-cargo state is a state in which cargo is not loaded into the work implement.

In this work vehicle, the upper limit value of the output torque of the engine is reduced when cargo is not loaded into the work implement. The load imposed on the work implement is low when cargo is not loaded into the work implement. Therefore, the effect imparted on the action of the work implement is low even when the upper limit value of the output torque of the engine is reduced. Accordingly, it is possible to inhibit a reduction in the ease of operation, and to reduce fuel consumption.

The work vehicle according to a ninth aspect of the present invention is the work vehicle according to the seventh aspect, further comprising a forward/reverse switching operation member for operating the switching between forward and reverse of the vehicle. The low-load conditions include that the work phase is a shuttle state. The shuttle state is a state in which the movement direction instructed by the forward/reverse switching operation member and the movement direction of the vehicle are different.

In this work vehicle, the upper limit value of the output torque of the engine is reduced when the vehicle is in a shuttle state. The shuttle state is a state that starts when the operator switches the vehicle between forward and reverse and ends when the action of the vehicle actually switches. Accordingly, when the vehicle is in a shuttle state, the condition is not one in which the vehicle is made to travel at high speed nor in which the work implement is being rapidly driven. For this reason, it is possible to inhibit a reduction in the ease of operation, and to reduce fuel consumption.

The work vehicle according to a tenth aspect of the present invention is the work vehicle according to the first aspect, wherein the controller determines whether the vehicle is traveling uphill. The controller reduces the reduction amount in the case that the vehicle is traveling uphill.

In this work vehicle, the reduction amount is reduced in the case that it has been determined that the vehicle is traveling uphill. Accordingly, it is possible to inhibit a reduction in the travel performance during uphill travel.

The method for controlling a work vehicle according to an eleventh aspect of the present invention is a method for controlling a work vehicle comprising: an engine, a travel device, and a work implement. The travel device causes a vehicle to travel by drive force from the engine. The work implement is driven by drive force from the engine. The method for controlling a work vehicle comprises the following steps: detecting engine rotation speed; detecting at least one among vehicle speed, vehicle acceleration, and engine-rotation-speed acceleration; assessing whether low-load conditions indicating that the vehicle is in a low-load state are satisfied; controlling the engine so that, when the low-load conditions are satisfied, an upper limit value of the output torque of the engine is made less than when the low-load conditions are not satisfied; and varying the reduction amount of the upper limit value of the output torque of the engine when the low-load conditions are satisfied, in accordance with at least one among the detected vehicle speed, the vehicle acceleration, and the engine-rotation-speed acceleration, and in accordance with variation in the detected engine rotation speed.

In this method for controlling a work vehicle, when the low-load conditions are satisfied, the upper limit value of the output torque of the engine is made less than when the low-load conditions are not satisfied. Fuel consumption is thereby reduced. Also, the reduction amount of the upper limit value of the output torque of the engine when the low-load conditions are satisfied is varied in accordance with the variation in the engine rotation speed and at least one of the vehicle speed, the vehicle acceleration, and the engine-rotation-speed acceleration. Therefore, the upper limit value of the output torque of the engine is not reduced uniformly by an amount set in advance, but the reduction amount is varied in accordance with the variation in the state of the engine rotation speed, the vehicle speed, and the like. Accordingly, rapid changes in the output torque of the engine are inhibited. In this way, a reduction in the ease of operation is inhibited.

Effects of the Invention

In the present invention, it is possible to inhibit a reduction in the ease of operation and to improve the effect of reduced fuel consumption.

BRIEF DESCRIPTION OF THE DRAWINGS

FIG. 6 is a view showing the low-load conditions and the torque reduction amount table;

FIG. 8 is a view showing an example of the torque reduction amount table;

FIG. 10 is a view showing examples of the variation in the engine torque curve produced by torque reduction amount calculated by the torque reduction amount table;

FIG. 11 is a view showing examples of the variation in the engine torque curve produced by torque reduction amount calculated by the torque reduction amount table;

FIG. 12 is a view showing an example of the variation in the engine torque curve produced by the torque reduction amount calculated by the torque reduction amount table;

FIG. 13 is a view showing the effect of the compensation engine rotation speed and the torque reduction compensation value on the torque reduction amount;

FIG. 14 is a view showing an example of a table for calculating the torque reduction compensation value;

FIG. 17 is a view showing an example of a table of the torque reduction amount according to another embodiment;

FIG. 18 is a view showing an example of a table of the torque reduction amount according to another embodiment;

DESCRIPTION OF EMBODIMENTS

Figure 1:
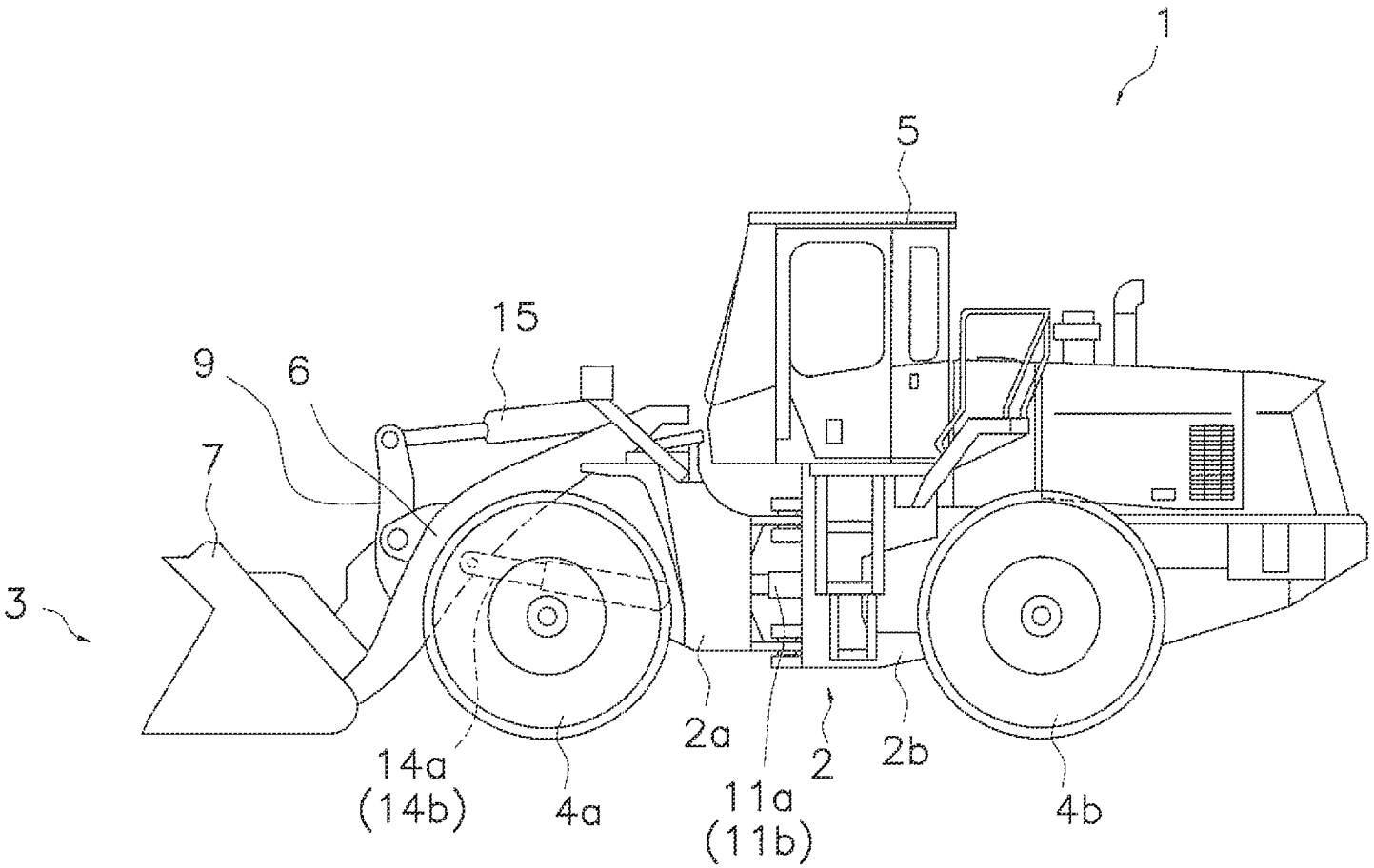
FIG. 1 is a side view of the work vehicle according to an embodiment of the present invention.
Figure 2:
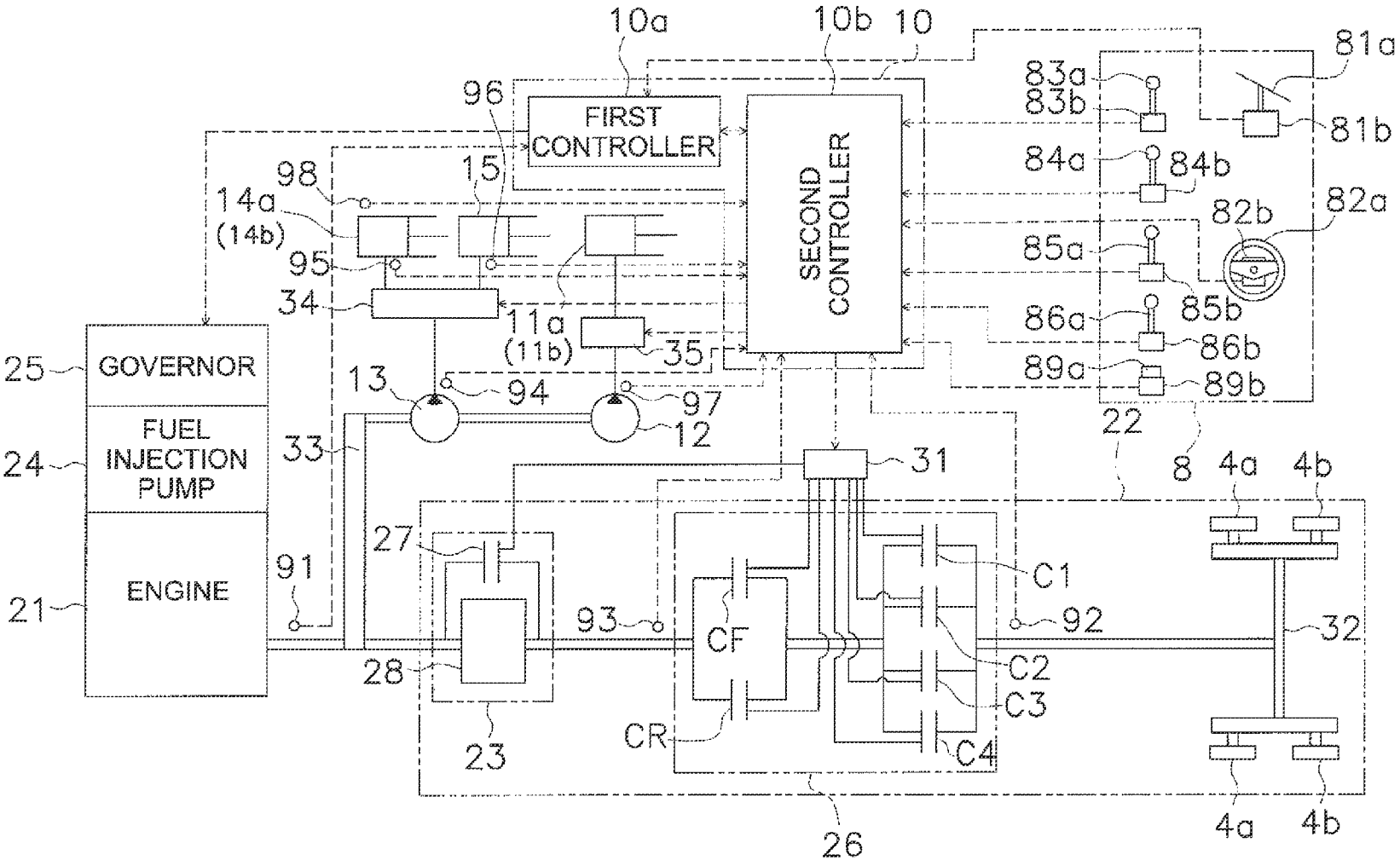
FIG. 2 is a schematic view showing the configuration of the work vehicle.

The work vehicle 1 according to an embodiment of the present invention is shown in FIGS. 1 and 2. FIG. 1 is a view of the external appearance of the work vehicle 1, and FIG. 2 is a schematic view showing the configuration of the work vehicle 1. The work vehicle 1 is a wheel loader, the work vehicle 1 being capable of traveling by front wheels 4*a* and rear wheels 4*b* being rotatably driven, and capable of performing desired work using a work implement 3.

The work vehicle 1 comprises a vehicle body frame 2, the work implement 3, the front wheels 4*a*, the rear wheels 4*b*, and a driver cabin 5, as shown in FIG. 1.

The vehicle body frame 2 has a front vehicle body section 2*a* and a rear vehicle body section 2*b*. The front vehicle body section 2*a* and the rear vehicle body section 2*b* are connected to each other so as to allow pivoting in the left and right directions. A pair of steering cylinders 11*a* and 11*b* is provided from the front vehicle body section 2*a* to the rear vehicle body section 2*b*. The steering cylinders 11*a* and 11*b* are hydraulic cylinders driven by hydraulic fluid from a steering pump 12 (see FIG. 2). The steering cylinders 11*a* and 11*b* expand and contract, whereby the front vehicle body section 2*a* pivots in relation to the rear vehicle body section 2*b*. The direction of progress (movement) of the vehicle is thereby changed. In FIGS. 1 and 2, only one of the steering cylinders 11*a* and 11*b* is shown, and the other is omitted.

The work implement 3 and the pair of front wheels 4*a* are attached to the front vehicle body section 2*a*. The work implement 3 is driven by the hydraulic fluid from the work implement pump 13 (see FIG. 2). The work implement 3 has a boom 6, a pair of lift cylinders 14*a* and 14*b*, a bucket 7, a bucket cylinder 15, and a bell crank 9. The boom 6 is mounted on the front vehicle body section 2*a*. One end of the lift cylinders 14*a* and 14*b* is attached to the front vehicle body section 2*a*. The other end of the lift cylinders 14*a* and 14*b* is attached to the boom 6. The lift cylinders 14*a* and 14*b* are made to expand and contract by hydraulic fluid from the work implement pump 13, whereby the boom 6 vertically pivots. In FIGS. 1 and 2, only one of the lift cylinders 14*a* and 14*b* is shown, and the other is omitted. The bucket 7 is attached to the distal end of the boom 6. One end of the bucket cylinder 15 is attached to the front vehicle body section 2*a*. The other end of the bucket cylinder 15 is attached to the bucket 7 via the bell crank 9. The bucket cylinder 15 is made to expand and contract by hydraulic fluid from the work implement pump 13, whereby the bucket 7 vertically pivots.

The driver cabin 5 and the pair of rear wheels 4*b* are attached to the rear vehicle body section 2*b*. The driver cabin 5 is disposed above the vehicle body frame 2, and houses a seat on which an operator sits, a later-described operation unit 8, and the like.

The work vehicle 1 comprises an engine 21, a travel device 22, the work implement pump 13, the steering pump 12, the operation unit 8, a controller 10, and the like, as shown in FIG. 2.

The engine 21 is a diesel engine, and the fuel amount injected into the cylinder is adjusted to control the output of the engine 21. This adjustment is made by a later-described first controller 10*a*, which controls an electronic governor 25 installed in a fuel injection pump 24 of the engine 21. A general all-speed control governor is used as the governor 25, and the engine rotation speed and fuel injection amount are adjusted in accordance with a load so that the engine rotation speed achieves a target speed that corresponds to a later-described accelerator operation amount. In other words, the governor 25 increases or reduces the fuel injection amount so that there is no deviation between a target engine rotation speed and the actual engine rotation speed. The engine rotation speed is detected by an engine rotation speed sensor 91 (first detector). The detection signal of the engine rotation speed sensor 91 is inputted to the first controller 10*a*.

The travel device 22 is a device for causing the vehicle to travel by the drive force from the engine 21. The travel device 22 has a torque converter device 23, a transmission 26, the above-described front wheels 4*a* and rear wheels 4*b*, and the like.

The torque converter device 23 has a lockup clutch 27 and a torque converter 28. The lockup clutch 27 can be switched between a connected state and a non-connected state. The torque converter 28 transmits the drive force from the engine 21 using oil as a medium in the case that the lockup clutch 27 is in a non-connected state. The input side and the output side of the torque converter 28 are directly connected when the lockup clutch 27 is in a connected state. The lockup clutch 27 is a hydraulic pressure-actuated clutch, and the feeding of hydraulic fluid to the lockup clutch 27 is controlled by a later-described second controller 10*b* via a clutch control valve 31 to thereby switch between the connected state and the non-connected state.

A transmission 26 has a forward clutch CF adapted for forward travel stages and a reverse clutch CR adapted for reverse travel stages. The clutches CF and CR are switched between the connected state and the non-connected state to thereby switch the vehicle between forward and reverse. The vehicle is in a neutral state when the clutches CF and CR are both in the non-connected state. The transmission 26 has a plurality of speed stage clutches C1 to C4 adapted for a plurality of speed stages, and can switch the reduction gear ratio to a plurality of stages. For example, in the transmission 26, four speed stage clutches C1 to C4 are provided, and the speed stages can be switched to four stages, i.e., first speed to fourth speed. The speed stage clutches C1 to C4 are hydraulic pressure-actuated hydraulic clutches. Hydraulic fluid is fed from a hydraulic pump (not shown) to the clutches C1 to C4 via the clutch control valve 31. The clutch control valve 31 is controlled by the second controller 10*b*, and the feeding of the hydraulic fluid to the clutches C1 to C4 is controlled, whereby the connected state and non-connected state of the clutches C1 to C4 are switched.

A transmission output speed sensor 92 for detecting the speed of the output shaft of the transmission 26 is provided to the output shaft of the transmission 26. Detection signals from the transmission output speed sensor 92 (second detector) are inputted to the second controller 10*b*. The second controller 10*b* calculates the vehicle speed on the basis of the detection signals of the transmission output speed sensor 92. Therefore, the transmission output speed sensor 92 functions as a vehicle speed sensor for detecting the vehicle speed. A sensor for detecting the rotational speed of other components may be used as a vehicle speed sensor in lieu of the output shaft of the transmission 26. The drive force outputted from the transmission 26 is transmitted to the front wheels 4*a* and the rear wheels 4*b* via a shaft 32, and the like, whereby the vehicle travels. The speed of the input shaft of the transmission 26 is detected by a transmission input speed sensor 93. The detection signals from the transmission input speed sensor 93 are inputted to the second controller 10*b*.

A portion of the drive force of the engine 21 is transmitted to the steering pump 12 and the work implement pump 13 via a PTO shaft 33. The work implement pump 13 and the steering pump 12 are hydraulic pumps driven by drive force from the engine 21. The hydraulic fluid discharged from the work implement pump 13 is fed to the lift cylinders 14*a* and 14*b* and the bucket cylinder 15 via a work implement control valve 34. The hydraulic fluid discharged from the steering pump 12 is fed to the steering cylinders 11*a* and 11 via a steering control valve 35. In this manner, the work implement 3 is driven by a portion of the drive force from the engine 21.

The pressure of the hydraulic fluid discharged from the work implement pump 13 (hereinafter referred to as "hydraulic pressure of the work implement pump") is detected by a first hydraulic pressure sensor 94. The pressure of the hydraulic fluid fed to the lift cylinders 14*a* and 14*b* (hereinafter referred to as "lift cylinder hydraulic pressure") is detected by a second hydraulic pressure sensor 95. Specifically, the second hydraulic pressure sensor 95 detects the hydraulic pressure in the cylinder head chamber to which hydraulic fluid is fed when the lift cylinders 14*a* and 14*b* are extended. The pressure of the hydraulic fluid fed to the bucket cylinder 15 (hereinafter referred to as "hydraulic pressure of the bucket cylinder") is detected by a third hydraulic pressure sensor 96. Specifically, the third hydraulic pressure sensor 96 detects the hydraulic pressure of the cylinder head chamber to which hydraulic fluid is fed when the bucket cylinder 15 is extended. The pressure of the hydraulic fluid discharged from the steering pump 12 (hereinafter referred to as "hydraulic pressure of the steering pump") is detected by a fourth hydraulic pressure sensor 97. The detection signals from the first to fourth hydraulic pressure sensors 94 to 97 are inputted to the second controller 10*b*.

The operation unit 8 is operated by the operator. The operation unit 8 has an accelerator operation member 81*a*, an accelerator operation detection device 81*b*, a steering operation member 82*a*, a steering operation detection device 82*b*, a boom operation member 83*a*, a boom operation detection device 83*b*, a bucket operation member 84*a*, a bucket operation detection device 84*b*, a gear shift operation member 85*a*, a gear shift operation detection device 85*b*, an FR operation member 86*a*, an FR operation detection device 86*b*, downshift operation member 89*a*, and a downshift operation detection device 89*b*, and the like.

The accelerator operation member 81*a* is, e.g., an accelerator pedal, and is operated in order to set the target rotation speed of the engine 21. The accelerator operation detection device 81*b* (third detector) detects the operation amount of the accelerator operation member 81*a* (hereinafter referred to as "accelerator operation amount"). The accelerator operation detection device 81*b* outputs the detection signal to the first controller 10*a*.

The steering operation member 82*a* is, e.g., a steering wheel, and is operated in order to operate the direction of progress of the vehicle. The steering operation detection device 82*b* detects the position of the steering operation member 82*a* and outputs detection signals to the second controller 10*b*. The second controller 10*b* controls the steering control valve 35 on the basis of detection signals from the steering operation detection device 82*b*. The steering cylinders 11*a* and 11*b* thereby expand and contract, and the direction of progress of the vehicle is changed.

The boom operation member 83*a* and the bucket operation member 84*a* are, e.g., operation levers, and are operated in order to actuate the work implement 3. Specifically, the boom operation member 83*a* is operated in order to actuate the boom 6. The bucket operation member 84*a* is operated in order to actuate the bucket 7. The boom operation detection device 83*b* detects the position of the boom operation member 83*a*. The bucket operation detection device 84*b* detects the position of the bucket operation member 84*a*. The boom operation detection device 83*b* and the bucket operation detection device 84*b* output detection signals to the second controller 10*b*. The second controller 10*b* controls the work implement control valve 34 on the basis of detection signals from the boom operation detection device 83*b* and the bucket operation detection device 84*b*. The lift cylinders 14*a* and 14*b* and the bucket cylinder 15 thereby expand and contract, and the boom 6 and the bucket 7 are actuated. Also, a boom angle detection device 98 for detecting the boom angle is provided to the work implement 3. The boom angle is the angle between the line that connects the center of rotational support between the front vehicle body section 2*a* and the boom 6 and the center of rotational support between the boom 6 and the bucket 7, and the line that connects the axial centers of the front and rear wheels 4*a* and 4*b*. The boom angle corresponds to the height of the bucket 7 from the ground. The boom angle detection device 98 outputs detection signals to the second controller 10*b*.

The gear shift operation member 85*a* is, e.g., a shift lever. The gear shift operation member 85*a* is operated in order to set an upper limit value of the speed stage when the automatic gear shift mode has been selected. For example, in the case that the gear shift operation member 85*a* is set to third speed, the transmission 26 can be switched from second speed to third speed, and it is not possible to switch to fourth speed. When the manual gear shift mode is selected, the transmission 26 is switched to the speed stage set by the gear shift operation member 85*a*. The gear shift operation detection device 85*b* detects the position of the gear shift operation member 85*a*. The gear shift operation detection device 85*b* outputs the detection signals to the second controller 10*b*. The second controller 10*b* controls the gear shifting of the transmission 26 on the basis of the detection signals from the gear shift operation detection device 85*b*. The automatic gear shift mode and the manual gear shift mode are switched by a gear shift mode switching member (not shown) operated by the operator.

The FR operation member 86*a* (forward/reverse switching operation member) is operated in order to switch the vehicle between forward and reverse. The FR operation member 86*a* can be switched to forward, neutral, and reverse positions. The FR operation detection device 86*b* detects the position of the FR operation member 86*a*. The FR operation detection device 86*b* outputs detection signals to the second controller 10*b*. The second controller 10*b* controls the clutch control valve 31 on the basis of the detection signals from the FR operation detection device 86*b*. The forward clutch CF and the reverse clutch CR are thereby controlled to switch the vehicle between forward, reverse, and neutral states.

The downshift operation member 89*a* is operated in order to switch the speed stage of the transmission 26 a single speed stage lower from the current speed stage when the automatic gear shift mode is selected. The downshift operation member 89*a* is a switch provided to, e.g., the gear shift operation member 85*a*. The downshift operation detection device 89*b* detects whether the downshift operation member 89*a* has been operated, and outputs detection signals to the second controller 10*b*. The second controller 10*b* controls the gear shifting of the transmission 26 on the basis of the detection signals from the gear shift operation detection device 85*b*. In other words, the second controller 10*b* switches the speed stage of the transmission 26 a single speed stage lower when it has been detected that the downshift operation member 89*a* has been operated.

The controller 10 has the first controller 10*a* and the second controller 10*b*. Each of the first controller 10*a* and the second controller 10*b* can be implemented in the form of a computer having: a storage device used as, e.g., program memory and/or work memory; and a CPU for executing a program.

Figure 3:
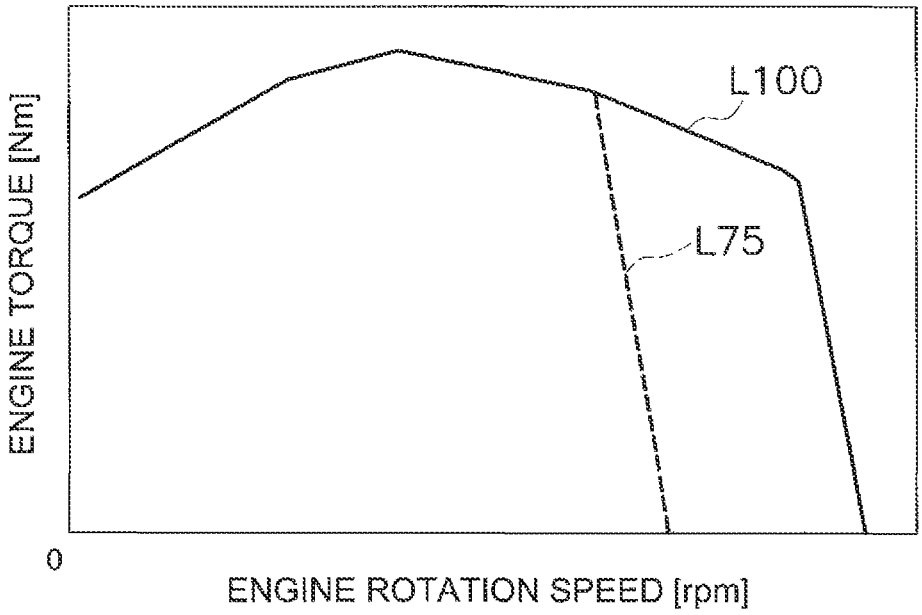
FIG. 3 is a view showing an example of the engine torque curve.

The first controller 10*a* sends engine command signals to the governor 25 so as to achieve a target engine rotation speed that corresponds to the accelerator operation amount. FIG. 3 shows the engine torque curve representing a torque upper limit value (hereinafter referred to as "torque upper limit value") that can be outputted by the engine 21 in accordance with the engine rotation speed. In FIG. 3, the solid line L100 indicates the engine torque curve when the accelerator operation amount is 100% in a high-load work phase in which later-described engine torque reduction control is not carried out. The engine torque curve corresponds to, e.g., the rated or maximum power output of the engine 21. The 100% accelerator operation amount refers to the state in which the accelerator operation member 81*a* is maximally operated. Also, the broken line L75 indicates the engine torque curve when the accelerator operation amount is 75% in a high-load work phase. The governor 25 controls the output of the engine 21 so that the output torque of the engine 21 (hereinafter referred to as "engine torque") becomes equal to or less than the engine torque curve. The control of the output of the engine 21 is carried out by, e.g., controlling the upper limit value of fuel injection amount to the engine 21. When engine torque reduction control is carried out, the first controller 10*a* receives a correction command signal from the second controller 10*b*. The first controller 10*a* corrects the command value of the engine command signal using the correction command signal, and sends the corrected command value to the governor 25. The correction command value is later described in detail.

The second controller 10*b* controls the transmission 26 and/or the torque converter device 23 in accordance with the travel state of the vehicle. For example, the second controller 10*b* automatically switches the speed stage of the transmission 26 and switches the lockup clutch 27 in accordance with the vehicle speed when the automatic gear shift mode is selected. The second controller 10*b* switches the transmission 26 to the speed stage selected by the gear shift operation member 85*a* when the manual gear shift mode is selected.

In addition to the above-described detection signals, detection signals for the inlet pressure, the outlet pressure, and the like of the torque converter device 23 are also inputted to the second controller 10*b*. The first controller 10*a* and the second controller 10*b* can communicate with each other by a wireless or wired connection. The detection signals of the engine rotation speed, the fuel injection amount, the accelerator operation amount, and the like are inputted from the first controller 10*a* to the second controller 10*b*. The second controller 10*b* calculates the correction value for correcting the command value of the engine command signal on the basis of these signals in the later-described engine torque reduction control. The second controller 10*b* transmits to the first controller 10*a* the correction command signal that corresponds to the correction value. The correction value is a value required for obtaining a desired reduction amount of the torque upper limit value. The first controller 10*a* and the second controller 10*b* can thereby bring the torque upper limit value to a desired level.

Engine torque reduction control is described below. First, various items of information including the engine rotation speed, the vehicle speed, and the operating state of the operating unit 8 are detected and the detection signals are sent to the second controller 10*b*. Next, the second controller 10*b* determines the work phase of the vehicle from the operating state of the travel device 22 and the work implement 3. It is determined whether predetermined low-load conditions are satisfied on the basis of the work phase and the operating state of the operating unit 8. The low-load conditions are conditions showing that the vehicle is in a low-load state, and a plurality of low-load conditions are provided. When a certain condition among the plurality of low-load conditions is satisfied, the torque reduction amount table that corresponds to the condition is selected. The torque reduction amount table is a table for calculating the reduction amount of the torque upper limit value (hereinafter referred to as "torque reduction amount"), and a relationship between the engine rotation speed, the vehicle speed, and the torque reduction amount are set in the table. The second controller 10*b* calculates the torque reduction amount that corresponds to the engine rotation speed and the vehicle speed using the selected torque reduction amount table. The second controller 10*b* calculates the correction value that corresponds to the calculated torque reduction amount, and sends the result as the correction command signal to the first controller 10*a*. The first controller 100*a* sends the engine command signal corrected by the correction command signal to the governor 25. In this way, when the low-load conditions are satisfied, the engine 21 is controlled so that the torque upper limit value is made less than when the low-load conditions are not satisfied. The torque reduction amount at this time is calculated on the basis of the engine rotation speed and the vehicle speed, and is repeatedly calculated while the engine 21 is being driven. Accordingly, the torque reduction amount continuously varies in accordance with the variation between the engine rotation speed and the vehicle speed. Therefore, the torque upper limit value varies continuously in accordance with the variation between the engine rotation speed and the vehicle speed. The processing performed in the engine torque reduction control is described in detail below with reference to the flowchart in FIG. 4.

First, various items of information are detected in the first step S1. Here, various items of information including the engine rotation speed and the vehicle speed are detected by detection signals from the operating unit 8 and various sensors.

Next, the corrected engine rotation speed is calculated in the second step S2. The corrected engine rotation speed is used for calculating the torque reduction amount produced by an above-described torque reduction amount table. The corrected engine rotation speed is calculated from the following formula (1).

$$Nt=Ne+a-Nbp \quad (1)$$

Figures 4, 5:
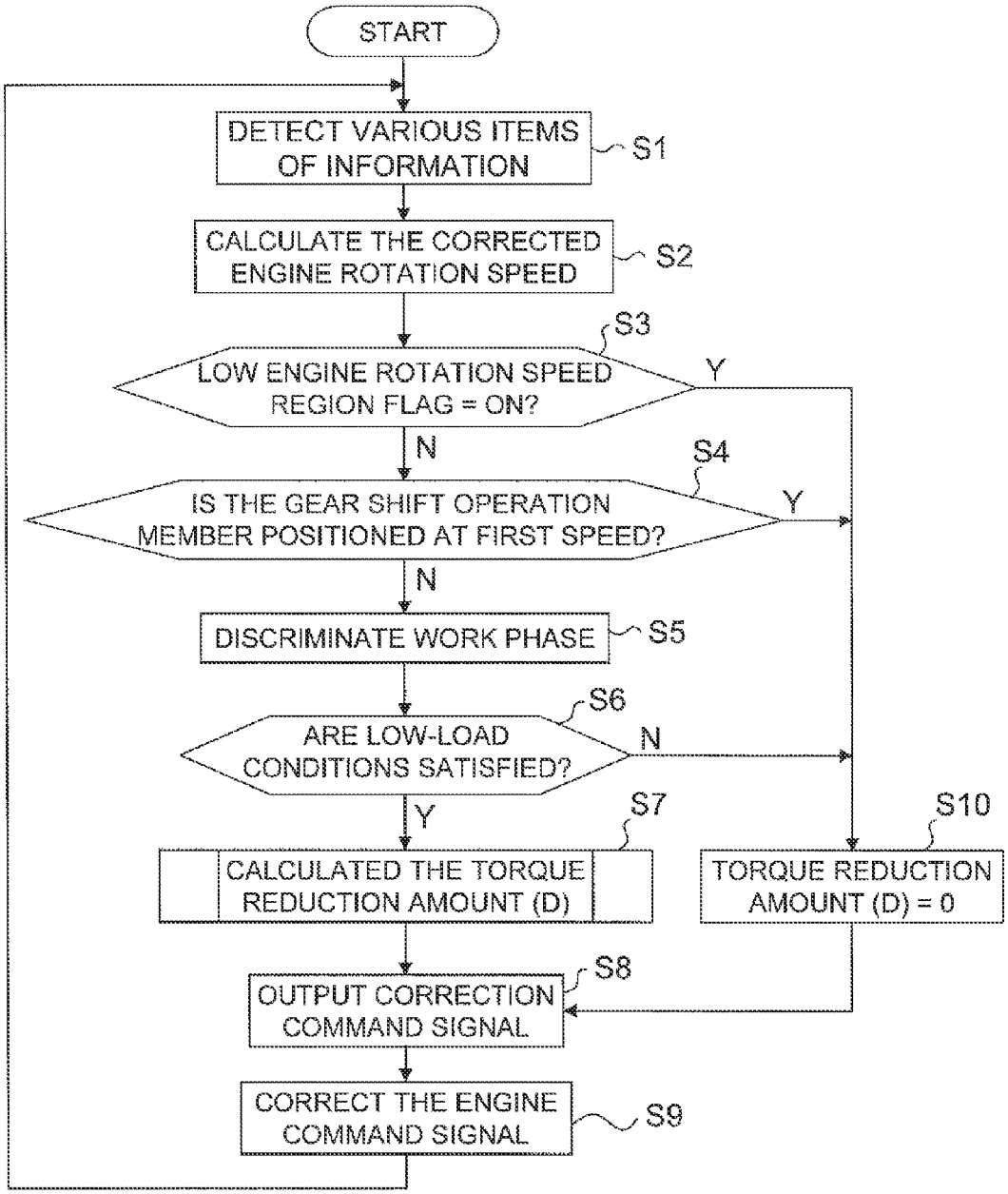
FIG. 4 is a flowchart showing the process in engine torque reduction control.
FIG. 5 is a view showing a table for calculating compensation engine rotation speed.

Nt is the corrected engine rotation speed. Ne is the current engine rotation speed detected by the engine rotation speed sensor 91. Nbp is the target engine rotation speed that corresponds to the accelerator operation amount and is calculated from the current accelerator operation amount. Specifically, Nbp is calculated from the table shown in FIG. 5 and the current accelerator operation amount. In FIG. 5, n0 to n10 is a predetermined numerical value and increases in sequence from n0 to n10. In other words, the Nbp increases in association with an increase in the accelerator operation amount. The values not shown in the table of FIG. 5 are obtained by interpolation of the values shown in the table. The same applies to other later-described tables. The term $\alpha$ is a predetermined constant and is the target engine rotation speed when the accelerator operation amount is a predetermined amount. For example, the constant $\alpha$ is set to the target engine rotation speed n10 when the accelerator operation amount is 100%. The corrected engine rotation speed is used for obtaining a torque reduction amount that corresponds to the current accelerator operation amount, by making use of the torque reduction amount table of when the accelerator operation amount is a predetermined amount. In other words, in the case that the constant $\alpha$ is n10, the torque reduction amount of when the accelerator operation amount is less than 100% can be obtained using the torque reduction amount table of when the accelerator operation amount is 100% (see FIG. 13 for Nbp and $\alpha$).

Returning to the flowchart of FIG. 4, it is determined whether or not a low engine rotation speed region flag is ON in the third step S3. The low engine rotation speed region flag is set to ON in the case that the engine rotation speed detected by the engine rotation speed sensor 91 is equal to or less than a predetermined low engine rotation speed Nlow, and is set to OFF in the case that the engine rotation speed is greater than the predetermined low engine rotation speed Nlow. The process proceeds to the tenth step S10 in the case that the low engine rotation speed region flag is ON in the third step S3. In the tenth step S10, the torque reduction amount is set to zero. In other words, the engine torque reduction control is not carried out.

In the fourth step S4, it is determined whether the gear shift operation member 85*a* is positioned in a first speed position. Here, the determination is made on the basis of the detection signals from the gear shift operation detection device 85*b*. In the case that the gear shift operation member 85*a* is positioned in the first speed position, the process proceeds to the tenth step S10, and the torque reduction amount is set to zero. In the case that the gear shift operation member 85*a* is not positioned in the first speed position, the process proceeds to the fifth step S5. In other words, the process proceeds to the fifth step S5 in the case that the gear shift operation member 85*a* is positioned in a speed stage position equal to or greater than second speed.

The work phase is determined in the fifth step S5. Specifically, the second controller 10*b* determines the work phase is the following manner.

First, the second controller 10*b* determines the travel status and the work status of the vehicle on the basis of the above-described detection signals. The travel status includes "stop," "forward," "reverse," and "shuttle." In the case that the vehicle speed is equal to or less than a predetermined stop threshold value, the second controller 10*b* determines that the travel status is "stop." The predetermined stop threshold value is a value that is sufficiently low enough to allow the vehicle to be considered to be stopped. In the case that the FR operation member 86*a* is set in the forward position and the vehicle is moving forward, the second controller 10*b* determines that the travel status is "forward." In the case that FR operation member 86*a* is set to reverse position and the vehicle is moving in reverse, the second controller 10*b* determines that the travel status is "reverse." Also, in the case that the progress direction instructed by the FR operation member 86*a* and the progress direction of the vehicle are different, the second controller 10*b* determines that the travel status is "shuttle." In other words, the term shuttle refers to a state in which the operator has switched the FR operation member 86*a* from forward to reverse, or from reverse to forward, but the progress direction of the vehicle has yet to be switched.

The work status includes "cargo-loaded," "no-cargo," and "excavation." The second controller 10*b* determines that the work status is "cargo-loaded" in the case that the lift cylinder hydraulic pressure is equal to or greater than a predetermined cargo-loaded threshold value. The second controller 10*b* determines that the work status is "no-cargo" in the case that the lift cylinder hydraulic pressure is less than the cargo-loaded threshold value. In other words, the term "no-cargo" refers to a state in which cargo is not loaded in the bucket 7, and the term "cargo-loaded" refers to a state in which cargo is loaded in the bucket 7. Therefore, the predetermined cargo-loaded threshold value is a value that is greater than the value of the lift cylinder hydraulic pressure in a state in which cargo is not loaded into the bucket 7, and is the value of the lift cylinder hydraulic pressure in which it can be deemed that cargo is loaded into the bucket 7. The second controller 10*b* determines the work status to be "excavation" in the case that: the lift cylinder hydraulic pressure is equal to or greater than a predetermined excavation hydraulic pressure threshold value; the travel status is "forward;" and the boom angle is equal to or less than a predetermined excavation angle threshold value. The term "excavation" refers to work in which the vehicle drives the bucket 7 into soil and lifts while moving forward. Therefore, the excavation hydraulic pressure threshold value corresponds to the value of the lift cylinder hydraulic pressure during excavation work. Also, the excavation angle threshold value corresponds to the value of the boom angle during excavation work. The second controller 10*b* determines the work phase by a combination of the above-mentioned travel status and the work status. Specifically, the work phase is determined in the seven phases of "no-cargo stopped," "cargo-loaded stopped," "no-cargo forward," "cargo-loaded forward," "no-cargo reverse," "cargo-loaded reverse," and "excavation."

In a sixth step S6, it is determined whether the low-load conditions have been satisfied. The low-load conditions are conditions showing that the vehicle is in a low-load state. Here, it is determined from the above-described work phase and the operating state of the operation member whether the low-load conditions are satisfied. For example, low-load conditions include a plurality of low-load conditions such as shown in FIG. 6. The low-load conditions are described later together with the torque reduction amount table. In the case that none of the low-load conditions are satisfied, it is determined that the vehicle is in high-load state. For example, in the case that the work phase is "excavation," the state is determined to be a high-load state. The state is determined to be a high-load state in the case that the vehicle is traveling uphill. For example, the tilt angle of the vehicle is detected, and the vehicle is determined to be traveling uphill when the tilt angle of the vehicle is equal to or greater than a predetermined angle and the vehicle is traveling. Alternatively, the vehicle acceleration is detected, and the vehicle is determined to be traveling uphill when the acceleration is less than a predetermined acceleration threshold value even though the operation amount of the accelerator operation member 81*a* is equal to or greater than a predetermined operation threshold value. In the case that the vehicle is determined to be in a high-load state, the torque reduction amount is set to zero in the tenth step S10. In other words, the torque upper limit value is not reduced. The process proceeds to step S7 in the case that any of the low-load conditions are satisfied.

The torque reduction amount is calculated in the seventh step S7. The method for calculating the torque reduction amount is later described.

The correction command signal is outputted in the eighth step S8. Here, the second controller 10*b* sends to the first controller 10*a* the correction command signal that corresponds to the torque reduction amount calculated in the seventh step S7.

The engine command signal is corrected in the ninth step S9. Here, the first controller 10*a* corrects the engine command signal by using the correction command signal and controls the engine 21, as described above.

Next, the method for calculating the torque reduction amount calculated in the seventh step S7 is described in detail with reference to the flowchart shown in FIG. 7.

First, the torque reduction amount table is selected in the eleventh step S11. Here, the torque reduction amount table is selected on the basis of the work phase and the operation state of the operation member. Specifically, the torque reduction amount table that corresponds to the low-load conditions determined in the sixth step S6 described above is selected. The torque reduction amount tables include a "dump table," a "shuttle table," a "no-cargo forward table," a "no-cargo reverse table," a "cargo-loaded forward table," and a "cargo-loaded reverse table," as shown in, e.g., FIG. 6. The "dump table" is selected in the case that: work phase is cargo-loaded forward; the operation direction of the bucket operation member 84*a* is toward the dump side; and operation amount is equal to or greater than a predetermined bucket operation threshold value (e.g., 50%). The "dump table" is also selected in the case that: the work phase is cargo-loaded stop; the operation direction of the bucket operation member 84*a* is toward the dump side; and operation amount is equal to or greater than a predetermined bucket operation threshold value (e.g., 50%). The term "dump side" refers to the operation direction when the blade of the bucket 7 is lowered such as when dump work is carried out. The operation amount of the bucket operation member 84*a* is a ratio with respect to a maximum operation amount and indicated by a percentage. In the neutral state, the operation amount is 0%. The "shuttle table" is selected in the case that the work phase is shuttle. The "no-cargo forward table" is selected in the case that the work phase is no-cargo forward. The "no-cargo reverse table" is selected in the case that the work phase is no-cargo reverse. The "cargo-loaded forward table" is selected in the case that the work phase is cargo-loaded forward and the position of the gear shift operation member 85*a* is second speed. The "cargo-loaded reverse table" is selected in the case that the work phase is cargo-loaded reverse. These low-load conditions are satisfied when the vehicle state is a low-load state in which the load is less than the above-described high-load state. The tables establish the relationship between a suitable engine rotation speed, vehicle speed, and torque reduction amount for a vehicle in a state in which each low-load condition is satisfied. These tables are obtained by experimentation or the like in advance and are stored in the second controller 10*b*.

An example of the torque reduction amount table is shown in FIG. 8. In FIGS. 8(*a*) to 8(*c*), V0 to Vmax, N11 to N16, N21, N31, a111 to a122, b111 to b152, and c111 to c151 indicate numerical values. V0 to Vmax are vehicle speeds, where V0<V1<V2<V3<V4<Vmax. In particular, Vmax is the maximum speed of the vehicle. Also, N11 to N16, N21, and N31 are engine rotation speeds, where 0<N11<N12<N13<N14<N15<N16, 0<N21<N12, and 0<N31<N12. Also, a111 to a122, b111 to b152, and c111 to c151 are torque reduction amounts, and are values greater than zero. In this manner, the relationships between the vehicle speed, the engine rotation speed, and the torque reduction amount of each table are different from each other. Therefore, the torque reduction amount varies in accordance with the low-load conditions, even when the engine rotation speed and the vehicle speed are the same.

For example, in the table of FIG. 8(*a*), the torque reduction amount is zero when the engine rotation speed is N11 or less. In contrast, in the table of FIG. 8(*c*), the torque reduction amount is zero when the engine rotation speed is N31 or less. In other words, in the table of FIG. 8(*a*), the torque upper limit value is reduced when the engine rotation speed is greater than N11. Also, in the table of FIG. 8(*c*), the torque upper limit value is reduced when the engine rotation speed is greater than N31. In this manner, the lower limit value of the engine rotation speed for which the torque upper limit value is to be reduced varies in accordance with the low-load conditions.

The lower limit values of these engine rotation speeds are set to a value at which it is difficult for the engine rotation speed to decrease by a large amount, even in the case that a large load is suddenly imposed in the low-load conditions. In other words, the lower limit values of the engine rotation speeds for which the torque upper limit value is to be reduced are values required for ensuring a minimum require engine output torque in the low-load conditions and are obtained and set in advance by experimentation or the like.

Also, in the table of FIG. 8(*a*), the torque reduction amount varies from zero to a122 in accordance with the engine rotation speed when the vehicle speed is Vmax. In contrast, in the table of FIG. 8(*b*), the torque reduction amount is zero without dependence on the engine rotation speed when the vehicle speed is Vmax. Furthermore, in the table of FIG. 8(*c*), the torque reduction amount is zero without dependence on the engine rotation speed when the vehicle speed is V4 or greater. Next, in the table of FIG. 8(*a*), a torque reduction amount that is greater than zero is set when the vehicle speed is greater than V2. In contrast, in the tables of FIGS. 8(*b*) and 8(*c*), a torque reduction amount that is greater than zero is set when the vehicle speed is greater than V0. In this manner, the lower limit value of the vehicle speed for which the torque upper limit value is to be reduced varies in accordance with the low-load conditions. These lower limit values of the vehicle speed are set to a value that does not hinder initial action in the low-load conditions in the case that a rapid operation is required to, e.g., escape from falling rock or avoid other danger. In other words, the lower limit values of the vehicle speed for which the torque upper limit value is to be reduced are values required for ensuring a minimum required engine output torque in the low-load conditions and are obtained and set in advance by experimentation or the like. For example, the vehicle speed is set to about 5 km/h as the lower limit value of the vehicle speed for which the torque upper limit value is to be reduced.

When the low-load conditions are different, the extent to which the operator perceives a reduction in ease of operation due to a reduction in engine torque will be different even at the same engine rotation speed and/or vehicle speed. Accordingly, a torque reduction amount table is used that differs in accordance with the low-load conditions as described above, whereby the engine torque can be reduced to the extent possible for each low-load condition without the operator perceiving a reduction in ease of operation.

Figure 7:
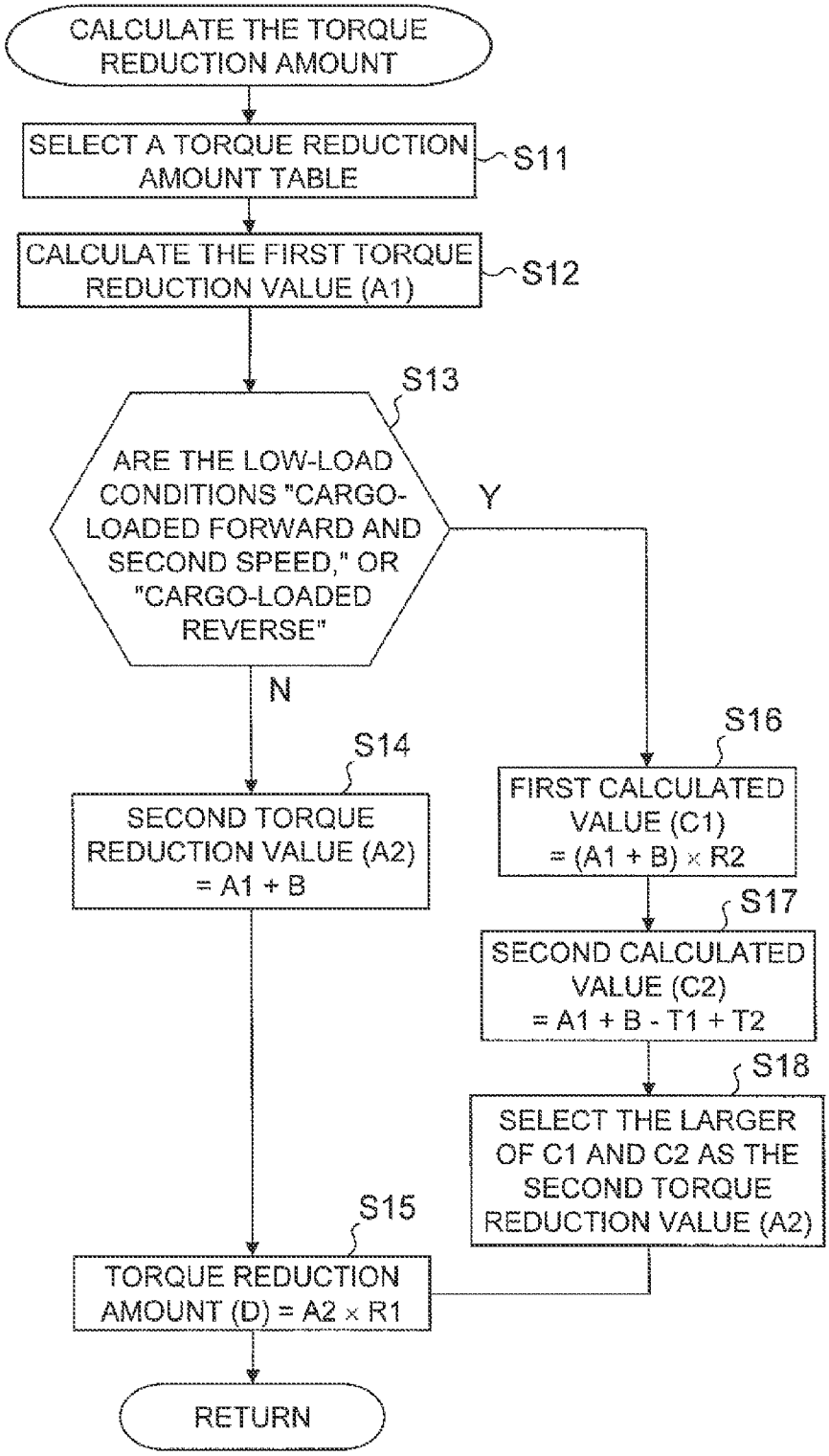
FIG. 7 is a flowchart showing the process for calculating the torque reduction amount in engine torque reduction control.

Returning to the flowchart of FIG. 7, the first torque reduction value is calculated in the twelfth step S12. Here, the torque reduction amount that corresponds to the current engine rotation speed and vehicle speed is calculated as the first torque reduction value with reference to the torque reduction amount table selected in the eleventh step S11.

Figure 9:
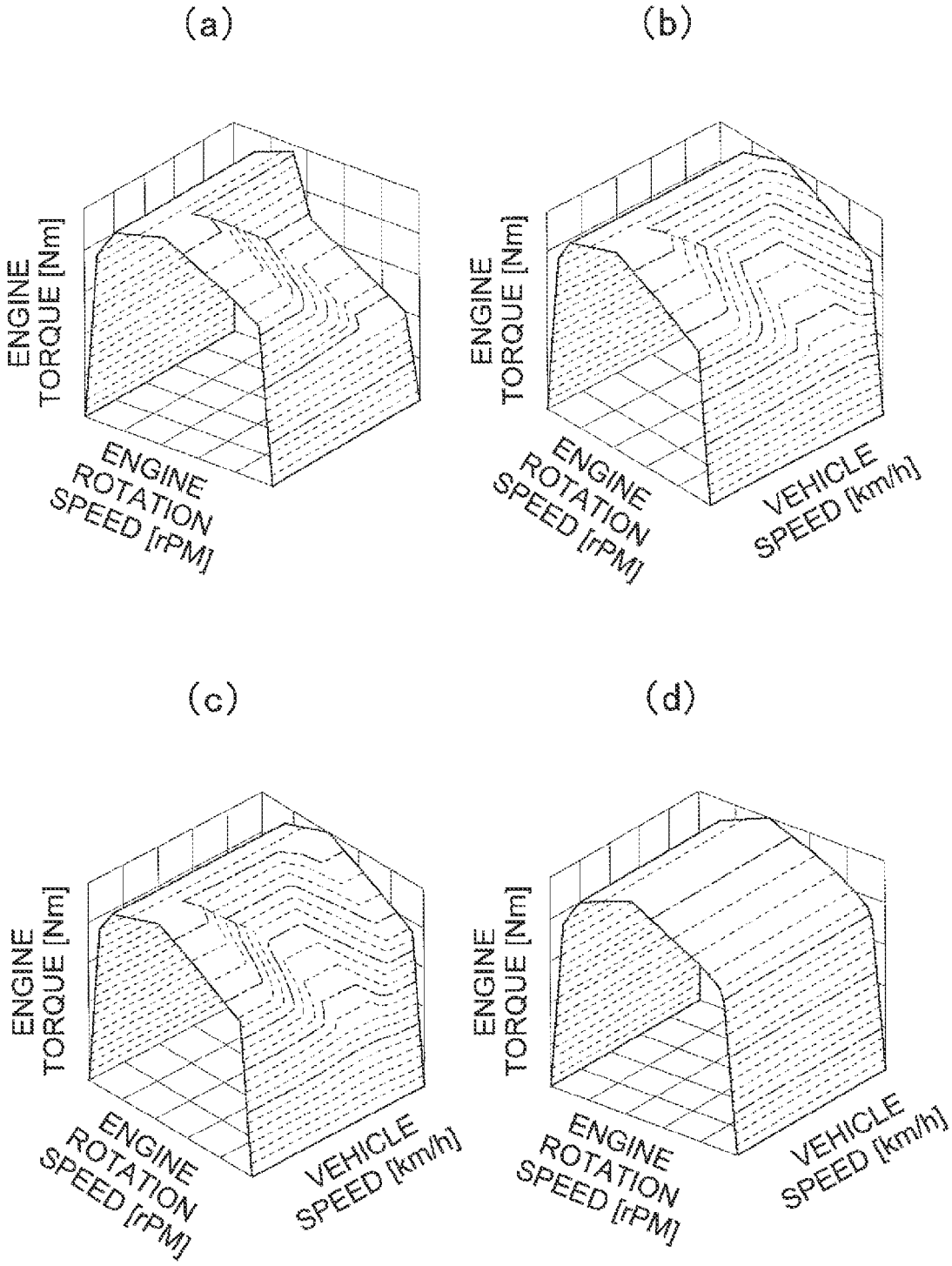
FIG. 9 is a view showing examples of the variation in the engine torque curve produced by torque reduction amount calculated by the torque reduction amount table.

FIG. 9 shows an example of the engine torque curve for which the torque upper limit value has been reduced by the torque reduction amount table. FIGS. 9(*a*) to 9(*d*) are 3D maps showing the relationship between the engine rotation speed, the vehicle speed, and the engine torque (upper limit value). It is apparent from FIGS. 9(*a*) to 9(*d*) that the torque reduction amount differs in accordance with the low-load conditions even with the same engine rotation speed and vehicle speed. FIG. 9(*a*) corresponds to the table shown in FIG. 8(*a*). For example, the table shown in FIG. 8(*a*) is used as the above-described dump table and shuttle table. FIG. 9(*b*) corresponds to the table shown in FIG. 8(*b*). For example, the table shown in FIG. 8(*b*) is used as the above-described no-cargo reverse table and cargo-loaded reverse table. FIG. 9(*c*) corresponds to the table shown in FIG. 8(*c*). For example, the table shown in FIG. 8(*c*) is used as the above-described no-cargo forward table. FIG. 9(*d*) is an example of an engine torque curve in the case that torque reduction is not carried out, and corresponds to the above-described cargo-loaded forward table for the case in which, e.g., a higher speed stage than second speed has been selected. The torque reduction amount table is set in accordance with variations in the low-load conditions with consideration given to the characteristics and/or method of use of the vehicle.

For example, in the map of FIG. 9(*a*), the engine rotation speed and the engine torque curve at different vehicle speeds are shown in FIG. 10(*a*). In FIG. 10(*a*), the solid line Lv2 is the engine torque curve of when the vehicle speed is V2. The broken line Lv3 is the engine torque curve of when the vehicle speed is V3. The two-dot chain line Lv4 is the torque curve of when the vehicle speed is V4. As described above, V2<V3<V4. In this manner, the torque reduction amount varies in accordance with the variation in the vehicle speed. Specifically, the torque reduction amount increases in accordance with the greater vehicle speed.

In the map of FIG. 9(*a*), the vehicle speed and the engine torque curve at different engine rotation speeds are shown in FIG. 10(*b*). In FIG. 10(*b*), the solid line Ln1 is the engine torque curve of when the engine rotation speed is N11. The broken line Ln2 is the engine torque curve of when the engine rotation speed is N12. The broken line Ln3 is the torque curve of when the engine rotation speed is N13. In this manner, the torque reduction amount varies in accordance with the variation in the engine rotation speed. The torque reduction amount is constant at zero when the engine rotation speed is N11, i.e., when the engine rotation speed is low; and the torque upper limit value is constant at Ta regardless of the variation in vehicle speed. When the engine rotation speed is N12, the torque upper limit value also varies in accordance with the variation in the vehicle speed when the vehicle speed varies between V2 and V4. However, when the vehicle speed is V2 or less, the torque upper limit value is constant at Tb1 regardless of variation in vehicle speed. Also, when the vehicle speed is V4 or greater, the torque upper limit value is constant at Tb2 regardless of variation in vehicle speed. Similarly, when the engine rotation speed is N13, the torque upper limit value also varies in accordance with the variation in vehicle speed when the vehicle speed varies between V2 and V4. However, when the vehicle speed is V2 or less, the torque upper limit value is constant at Tc1 (<TA<Tb1) regardless of variation in the vehicle speed. Also, when the vehicle speed is V4 or greater, the torque upper limit value is constant at Tc2 (Ta<Tb2) regardless of variation in the vehicle speed.

As described above, the torque reduction amount varies in accordance with the variation between the vehicle speed and the engine rotation speed, even when the low-load conditions are the same.

The engine rotation speed and engine torque curve at the same vehicle speed in the map of FIG. 9(*a*) and the map of FIG. 9(*b*) are shown in FIGS. 11(*a*) and 11(*b*), respectively. FIG. 11(*a*) is the engine rotation speed and engine torque curve in the map of FIG. 9(*a*). In FIG. 11(*a*), the broken line Lha is the engine torque curve of when the torque reduction amount is zero. The solid line Lla is the engine rotation speed and engine torque curve reduced by the torque reduction table. FIG. 11(*b*) is the engine rotation speed and engine torque curve in the map of FIG. 9(*b*). In FIG. 11(*b*), the broken line Lhb is the engine torque curve of when the torque reduction amount is zero. The solid line Llb is the engine rotation speed and engine torque curve reduced by the torque reduction table. It is apparent from these diagrams that the torque reduction amount of the map in FIG. 9(*b*) is less than that of the map in FIG. 9(*a*). In this manner, the torque reduction amount differs depending on the low-load conditions even at the same vehicle speed. For example, in work that involves later-described V-shaped work or other short distances, the engine torque curve shown by the solid line Lla of FIG. 11(*a*) is effective particularly in low-load conditions that are based on work phases in which the load on the work vehicle 1 is low.

The engine torque curve shown by the solid line Llb of FIG. 11(*b*) is effective in low-load conditions that are based on work phases in which the load on the work vehicle 1 is high. In the case that the load on the work vehicle 1 increases further, it is possible to use an engine torque curve in which the engine torque curve shown by the solid line Llb is brought close to the engine torque curve shown by the broken line Lhb. In this case, it is possible to use an engine torque curve that is brought even closer to the engine torque curve shown by the solid line Lhb, in association with the increase in the load.

FIG. 12 shows the vehicle speed and engine torque curve at the same engine rotation speed in FIGS. 9(*a*) and 9(*c*). The solid line Lva is the vehicle speed and engine torque curve in FIG. 9(*a*). The broken line Lvc is the vehicle speed and engine torque curve in FIG. 9(*c*). The two-dot chain line Lv0 is the vehicle speed and engine torque curve of when the torque reduction amount is zero. It is apparent from FIG. 12 that the torque reduction amount of the map of FIG. 9(*a*) varies more gradually with respect to variation in vehicle speed than that of the map of FIG. 9(*c*). In this manner, the variation in the torque reduction amount differs depending on the low-load conditions even with the same engine rotation speed. The broken line Lvc shows that the torque upper limit value is reduced when the vehicle speed is in an intermediate range of greater than V0 and less than V4. More specifically, the torque reduction amount increases in accordance with the increase in vehicle speed when the vehicle speed is greater than V0 and less than V1. The torque reduction amount is constant when the vehicle speed is equal to or greater than V1 and equal to or less than V3. The torque reduction amount decreases in accordance with the increase in the vehicle speed when the vehicle speed is greater than V3 and less than V4.

In the twelfth step S12, the vehicle speed detected by the transmission output speed sensor 92 is used as the current vehicle speed when the first torque reduction value which uses a torque reduction amount table is calculated. The engine rotation speed detected by the engine rotation speed sensor 91 is used as the current engine rotation speed when the accelerator operation amount is 100%. The corrected engine rotation speed calculated in second step S2 is used as the current engine rotation speed in the case that the accelerator operation amount is less than 100%.

FIG. 13 shows the process for correcting the engine torque curve in the case that a corrected engine rotation speed is used. The two-dot chain line L100 is the engine torque curve of when the accelerator operation amount is 100% and the torque reduction amount is zero. The single-dot chain line L100' is the engine torque curve of when the torque of the engine torque curve L100 is reduced on the basis of the torque reduction amount table in which the accelerator operation amount is set to 100%. The broken line Lcn is the engine torque curve of when the torque reduction amount has been calculated using the corrected engine rotation speed and is an engine torque curve in which the torque has been reduced when the accelerator operation amount is 75%. In this manner, the corrected engine rotation speed is used, whereby the torque difference (torque reduction amount) between the two-dot chain line L100 and the single-dot chain line L100' is corrected to the torque difference (torque reduction amount) between the two-dot chain line L100 and the broken line Lcn. In other words, the first torque reduction value is calculated using the corrected engine rotation speed, whereby the torque reduction amount can be corrected with consideration given to the accelerator operation amount. The torque reduction amount table is thereby not required to be set for each accelerator operation amount.

Returning to the flowchart of FIG. 7, it is determined in the 13th step S13 whether the low-load conditions are "cargo-loaded forward and the position of gear shift operation member is second speed," or "cargo-loaded reverse." The process proceeds to the 16th step S16 in the case that the low-load conditions are "cargo-loaded forward and the position of gear shift operation member is second speed," or "cargo-loaded reverse." In other words, the process proceeds to the 16th step S16 in the case that the cargo-loaded forward table or the cargo-loaded reverse table is selected in the eleventh step S11. The process proceeds to the 14th step S14 in the case that the low-load conditions are not "cargo-loaded forward and the position of gear shift operation member is second speed," or "cargo-loaded reverse." In other words, in the eleventh step S11, the process proceeds to the 14th step S14 in the case that any of the "dump table," the "shuttle table," the "no-cargo forward table," and the "no-cargo reverse table" are selected.

A second torque reduction value A2 is calculated in the 14th step S14. The second torque reduction value A2 is calculated using the following formula (2).

$$A2=A1+B \tag{2}$$

A1 is the first torque reduction value calculated in the twelfth step S12. B is the torque reduction correction value and is a value that varies in accordance with the accelerator operation amount. Specifically, the torque reduction correction value is obtained from the torque reduction correction value table shown in FIG. 14. In FIG. 14, a1 to a7 and b1 to b5 are predetermined numerical values. Also, $0<a1<a2<a3<a4<a5<a6<a7$, and $b1>b2>b3>b4>b5>0$. In other words, the torque reduction correction value is lower in association with a greater accelerator operation amount. The torque reduction correction value is zero when the accelerator operation amount greater than a predetermined value a7 (e.g., 85%).

In FIG. 13, the engine torque curve of when the torque reduction correction value is used is shown by a solid line Lca. This engine torque curve is the engine torque curve of when the first torque reduction value is calculated by the corrected engine rotation speed and of when the second torque reduction value is calculated using the torque reduction correction value. The above-described broken line Lcn is the engine torque curve of when the first torque reduction value is calculated using the corrected engine rotation speed and of when the second torque reduction value is calculated without using the torque reduction correction value. In either case, the accelerator operation amount is the same (e.g., 75%). In this manner, the second torque reduction value is calculated using the torque reduction correction value, whereby the torque reduction amount can be corrected with consideration given to the accelerator operation amount.

The torque reduction amount D is calculated in the 15th step S15. The torque reduction amount D is calculated using the following formula (3).

$$D=A2+R1 \tag{3}$$

Figures 15, 16:
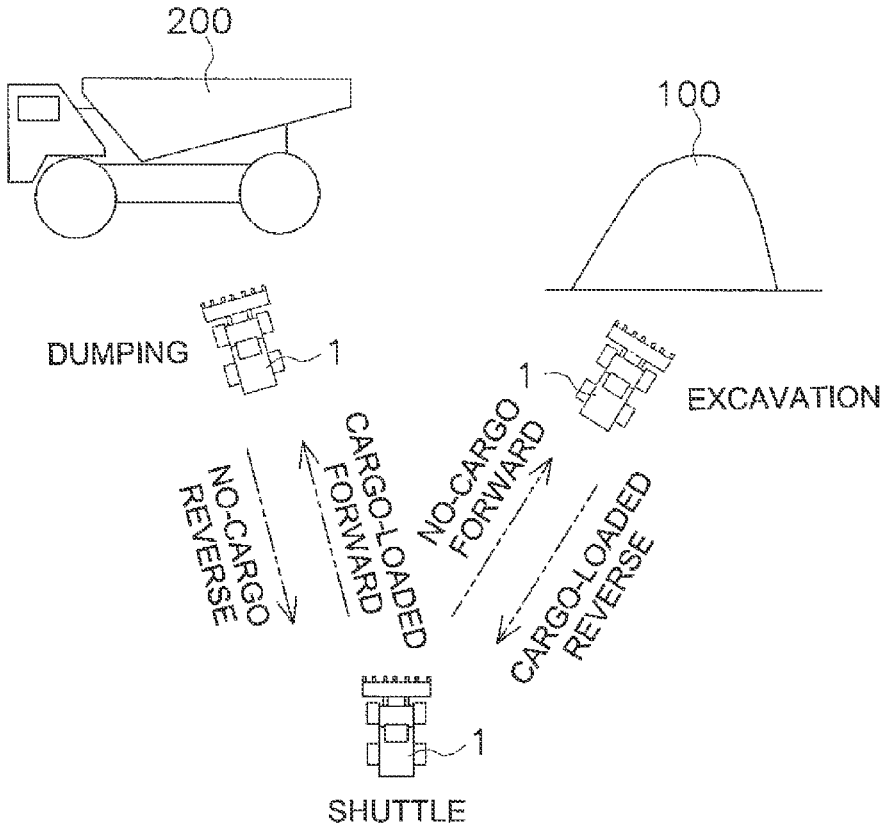
FIG. 15 is a view showing an example of a table for calculating low-acceleration, low-speed reduction ratio.
FIG. 16 is a schematic view showing the operation of the vehicle during V-shaped work.

A2 is the second torque reduction value calculated in the 14th step S14. R1 is the reduction ratio during low-acceleration and low-speed. The reduction ratio during low-acceleration and low-speed is calculated by selecting the larger of the reduction ratio ra obtained using the accelerator operation amount and the reduction ratio rv using the vehicle speed. The reduction ratio ra obtained using the accelerator operation amount is calculated from the reduction ratio calculation table shown in FIG. 15(*a*). In the table of FIG. 15(*a*), AC1 and AC2 show numerical values, where $0<AC1<AC2$. The reduction ratio ra is zero when the accelerator operation amount is less than a predetermined value AC1 (e.g., 70%). In other words, the torque reduction amount is zero when the accelerator operation amount is low. Also, the reduction ratio ra is 1 when the accelerator operation amount is equal to or greater than a predetermined value AC2 (e.g., 90%). The reduction ratio ra is calculated by proportional computation when the accelerator operation amount is between the predetermined values AC1 and AC2. Also, the reduction ratio rv obtained using the vehicle speed is calculated from the reduction ratio calculation table shown in FIG. 15(*b*). In the table of FIG. 15(*b*), VL1 and VL2 show numerical values, where 0<VL1<VL2. The reduction amount rv is zero when the vehicle speed is equal to or less than the predetermined value VL1. In other words, the torque reduction amount is zero when the vehicle speed is low. The reduction ratio rv is 1 when the vehicle speed is equal to or greater than the predetermined value VL2. The reduction ratio rv is calculated by proportional computation when the vehicle speed is between VL1 and VL2. Such a reduction ratio during low-acceleration, low speed is used to thereby make it possible improve acceleration from a low vehicle speed.

In the 16th step S16 to 18th step S18, the second torque reduction value is calculated using a different method from that described above in the case that the low-load conditions are "cargo-loaded forward and the position of the gear shift member is second speed," or "cargo-loaded reverse."

First, in the 16th step S16, a first calculation value C1 is calculated using the following formula (4).

$$C1=(A1+B)\times R2 \quad (4)$$

The method for calculating the first torque reduction value A1 and the torque reduction correction value B is the same as that described above. R2 is the cargo-loaded state reduction ratio. The cargo-loaded state reduction ratio R2 is set envisioning the case in which the operator does not perceive discomfort even when the torque reduction amount is increased to be greater than the value obtained by subtracting a later-described work implement pump estimated torque from the engine torque (torque upper limit value). For example, the cargo-loaded state reduction ratio R2 is a value that is greater than 0 and less than 1, and is set to a value of, e.g., "0.4" or the like. The cargo-loaded state reduction ratio R2 is calculated from the reduction ratio map that corresponds to the estimated output torque of the work implement pump 13.

In the 17th step S17, a second calculation value C2 is calculated using the following formula (5).

$$C1=A1+B-T1+T2 \quad (5)$$

The method for calculating the first torque reduction value A1 and the torque reduction correction value B is the same as that described above. T1 is a work implement pump estimated torque. The work implement pump estimated torque T1 is the torque required for driving the work implement pump 13. The work implement pump estimated torque T1 is calculated as the work implement pump estimated torque T1 on the basis of the product of the discharge displacement of the work implement pump 13 and the pressure of the work implement pump 13 detected by the first hydraulic pressure sensor 94. T2 is the neutral output torque of the work implement pump 13. In other words, T2 is the torque required to drive the work implement pump 13 in a neutral state in which the boom operation member 83*a* and the bucket operation member 84*a* are not being operated. In formula (5) described above, consideration is given to the torque of the work implement pump, but the second calculation value C2 may be calculated with consideration given also to the drive torque of the hydraulic pump for driving the steering pump 12 and/or other hydraulic actuators.

In the 18th step S18, the larger of the first calculation value C1 and the second calculation value C2 is selected as the second torque reduction value A2. A torque reduction value 1) is calculated in the 15th step S15 using formula (3) described above.

The process described above from the first step S1 to ninth step S9 shown in FIG. 4, and the process from the eleventh step S11 to the 18th step S18 shown in FIG. 7 are repeatedly carried out while the engine 21 is being driven.

In the work vehicle according to the present embodiment, when the low-load conditions are satisfied, the torque upper limit value is made less than that of when the low-load conditions are not satisfied. In this way, fuel consumption can be reduced. Also, the torque reduction amount varies in accordance with the variation in the engine rotation speed and vehicle speed. Therefore, the torque reduction amount is continuously varied in accordance with variation in the engine rotation speed, the vehicle speed, and the like, rather than the torque upper limit value being uniformly reduced by an amount set in advance. Accordingly, sudden variation in the engine torque can be inhibited. It is thereby possible to inhibit a reduction in ease of operation. Also, the torque reduction amount varies in accordance with the low-load conditions because a torque reduction amount table that corresponds to each low-load condition is provided. Therefore, it is possible to set a suitable torque reduction amount that corresponds to the low-load conditions of the vehicle. The engine torque can thereby be reduced to the extent possible for each low-load condition in a range that does not allow the operator to perceive a reduction in ease of operation.

Described below is the engine torque reduction control for when the work vehicle 1 is carrying out, e.g., so-called V-shaped work. V-shaped work is work in which the work vehicle 1 lifts soil or other cargo 100 using the work implement 3, and loads the cargo into a dump truck or other loading position 200, as shown in FIG. 16. When the V-shaped work is carried out, a movement over a relatively short distance is repeated, and the gear shift operation member 85*a* is therefore set in the second speed position. First, the work vehicle 1 moves toward the cargo 100. The work phase at this time is "no-cargo forward." Accordingly, the engine torque is reduced on the basis of the "no-cargo forward table" by the processing of the eleventh step S11 to 13th step S13, the 14th step S14, and the 15th step S15 of FIG. 7. Next, the work vehicle 1 drives into the cargo 100, and loads and lifts the cargo 100 using the bucket 7. The work phase at this time is "excavation." Accordingly, the engine torque is not reduced. Next, the work vehicle 1 retreats in a state having cargo 100 carried in the bucket 7. At this time, the work phase is "cargo-loaded reverse." Accordingly, the engine torque is reduced on the basis of the "cargo-loaded reverse table" by the processing of the eleventh step S11 to 13th step S13, the 16th step S16 to 18th step S18, and the 15th step S15 of FIG. 7. Next, the operator switches the FR operation member 86*a* from the reverse position to the forward position. At this time, the work phase is "shuttle" while the progress direction of the work vehicle 1 switches from reverse to forward. Accordingly, the engine torque is reduced on the basis of the "shuttle table" by the processing of the eleventh step S11 to 13th step S13, the 14th step S14, and the 15th step S15 of FIG. 7. Next, the work vehicle 1 moves forward toward a loading position 200 in a state in which the cargo 100 carried in the bucket 7. At this time, the work phase is cargo-loaded forward. Accordingly, the engine torque is reduced on the basis of the "cargo-loaded forward table" by the processing of the eleventh step S11 to 13th step S13, the 16th step S16 to 18th step S18, and the 15th step S15 of FIG. 7. Next, the operator operates the bucket operation member 84*a* and lowers the cargo 100 in the bucket 7 into the loading position 200 in a state in which the work vehicle 1 is positioned near the loading position 200. At this time, the low-load conditions of "dumping" are satisfied. Accordingly, the engine torque is reduced on the basis of the "dumping table" by the processing of the eleventh step S11 to 13th step S13, the 14th step S14, and the 15th step S15 of FIG. 7. Next, the operator switches the FR operation member 86*a* from the forward position to the reverse position, and the work vehicle 1 moves in reverse away from the loading position 200. At this time, the work phase is "no-cargo reverse." Accordingly, the engine torque is reduced on the basis of the "no-cargo reverse table" by the processing of the eleventh step S11 to 13th step S13, the 14th step S14, and the 15th step S15 of FIG. 7. Next, the operation switches the FR operation member 86*a* from the reverse position to the forward position. At this time, the work phase is "shuttle" while the progress direction of the work vehicle 1 switches from reverse to forward. Accordingly, the engine torque is reduced on the basis of the "shuttle table" by the processing of the eleventh step S11 to 13th step S13, the 14th step S14, and the 15th step S15 of FIG. 7. The actions described above are repeated.

The torque reduction amount is set to zero when the engine rotation speed is equal to or less than a predetermined speed in each table, even when the low-load conditions are satisfied. The predetermined engine rotation speed is set for each torque reduction amount table and therefore varies when the low-load conditions vary. Accordingly, the engine torque can be reduced to the extent possible for each low-load condition in a range that does not allow the operator to perceive a reduction in ease of operation. The low-load conditions showing that the vehicle is in a low-load state include the work phase. Accordingly, the predetermined engine rotation speed may be varied in accordance with the work phase in lieu of the low-load conditions.

The torque reduction correction value is lower in association with a greater accelerator operation amount. In other words, the lower the accelerator operation amount is, the greater the torque reduction correction value is. Therefore, the torque reduction amount is set to a low value when the operator is considerably operating the accelerator. The operator desires a high output when the operator is firmly operating the accelerator, and the torque reduction amount is thereby set to a low value, whereby the operator can be inhibited from perceiving a reduction in ease of operation. The torque reduction amount is set to a large value when the operator is lightly operating the accelerator. The operator does not desire a high output when the operator is lightly operating the accelerator, and even if the torque reduction amount is thereby set to a high value, the operator is unlikely to perceive a reduction in ease of operation. Accordingly, fuel consumption can be improved without the operator perceiving a reduction in ease of operation.

The torque reduction amount is zero when the vehicle speed is Vmax as shown in the torque reduction amount tables of FIGS. 8(*b*) and 8(*c*). Accordingly, a reduction in travel performance during high-speed travel can be inhibited.

An embodiment of the present invention was described above, but the present invention is not limited thereto; various modifications are possible within a scope that does not depart from the spirit of the invention.

For example, the torque reduction amount may be calculated on the basis of the vehicle acceleration in lieu of the vehicle speed. In other words, the torque reduction amount table may establish a relationship between the engine rotation speed, the vehicle acceleration, and the torque reduction amount, as shown in FIG. 17. The tables shown in FIGS. 17(*a*), 17(*b*), and 17(*c*) are torque reduction amount tables used in different low-load conditions, respectively. In FIGS. 17(*a*), 17(*b*), and 17(*c*), VA1 to VAmax, N21 to N26, a211 to a253, b211 to b255, and c211 to c255 indicate numerical values. VA1 to VAmax are vehicle acceleration s, where 0<VA1<VA2<V3<VA4<VAmax. Also, N21 to N26 are engine rotation speeds, where 0<N21<N22<N23<N24<N25<N26. Also, a211 to a253, b211 to b255, and c211 to c255 are torque reduction amounts, and are values greater than zero. In this manner, the torque reduction amounts of each table vary in accordance with the variation in the vehicle acceleration and the engine rotation speed. The relationships between the vehicle acceleration, the engine rotation speed, and the torque reduction amount of each table are different from each other. Therefore, the torque reduction amount varies in accordance with the low-load conditions, even when the engine rotation speed and the vehicle acceleration are the same.

Alternatively, the torque reduction amount may be calculated on the basis of the engine-rotation-speed acceleration in lieu of the vehicle speed. In other words, the torque reduction amount table may establish a relationship between the engine rotation speed, and the engine-rotation-speed acceleration, as shown in FIG. 18. The tables shown in FIGS. 18(*a*), 18(*b*), and 18(*c*) are torque reduction amount tables used in different low-load conditions, respectively. In FIGS. 18(*a*), 18(*b*), and 18(*c*), EA1 to EAmax, N31 to N36, a311 to a353, b311 to b355, and c311 to c355 indicate numerical values. EA1 to EAmax are engine-rotation-speed accelerations, where 0<EA1<EA2<EA3<EA4<EAmax. Also, N31 to N36 are engine rotation speeds, where 0<N31<N32<N33<N34<N35<N36. Also, a311 to a353, b311 to b355, and c311 to c355 are torque reduction amounts, and are values greater than zero. For example, when the engine rotation speed is N32 and the engine-rotation-speed acceleration is EA1, the reduction amount is set to zero in accordance with the table of FIG. 18(*a*). When the engine rotation speed is the unchanged at N32, but the engine-rotation-speed acceleration is EA3, which is greater than EA1, the reduction amount is set to a311 in accordance with the table of FIG. 18(*a*). When the engine rotation speed is N32 in the same manner as above, the reduction amount is set to b311 in accordance with the table of FIG. 18(*b*), even when the engine-rotation-speed acceleration is EA1. In this manner, the torque reduction amounts of each table vary in accordance with the variation in the engine-rotation-speed acceleration and the engine rotation speed. The relationships between the engine-rotation-speed acceleration, the engine rotation speed, and the torque reduction amount of each table are different from each other. Therefore, the torque reduction amount varies in accordance with the low-load conditions, even when the engine rotation speed and the engine-rotation-speed acceleration are the same.

Also, the calculation of the torque reduction amount on the basis of any among the vehicle speed, the vehicle acceleration, and the engine-rotation-speed acceleration may differ for each low-load condition. For example, a torque reduction amount table that establishes a relationship between "the engine rotation speed, the vehicle speed, and the torque reduction amount" may be used in a first low-load condition, a torque reduction amount table that establishes a relationship between "the engine rotation speed, the vehicle acceleration, and the torque reduction amount" may be used in a second low-load condition, and a torque reduction amount table that establishes a relationship between "the engine rotation speed, the engine-rotation-speed acceleration, and the torque reduction amount" may be used in a third low-load condition.

Also, it is possible to set a plurality of torque reduction amount tables in which the vehicle speed, the vehicle acceleration, and the engine-rotation-speed acceleration differ in a single low-load condition, and the largest torque reduction amount may be selected from these torque reduction amount tables. For example, three torque reduction amount tables may be set for a single low-load condition, the three torque reduction amount tables being a torque reduction amount table that establishes the relationship between "the engine rotation speed, the vehicle speed, and the torque reduction amount," a torque reduction amount table that establishes the relationship between "the engine rotation speed, the vehicle acceleration, and the torque reduction amount," and a torque reduction amount table that establishes the relationship between "the engine rotation speed, the engine-rotation-speed acceleration, and the torque reduction amount." The largest reduction amount in the current vehicle state may be selected from these torque reduction amount tables.

The engine-rotation-speed acceleration refers to the amount of variation per unit of time in the engine rotation speed. The engine-rotation-speed acceleration may be detected by a sensor for detecting acceleration. Alternatively, the controller 10 may calculate the engine-rotation-speed acceleration from the engine rotation speed detected by the engine rotation speed sensor 91. The torque reduction amount may be calculated using a computation formula without dependence on a table. In FIGS. 17(*a*) to 17(*c*), the same reference numerals N21 to N26 in FIG. 17(*a*), N21 to N26 in FIG. 17(*b*), and N21 to N26 in FIG. 17(*c*) are used, but are not required to be the same values. The reference numerals N31 to N36 of FIGS. 18(*a*) to 18(*c*) are similarly not required to be the same values.

In the embodiment described above, a corrected engine rotation speed is used, whereby the torque reduction amount that corresponds to the current accelerator operation amount is obtained from the torque reduction amount table of when the accelerator operation amount is 100%. A torque reduction amount that corresponds to when the accelerator operation amount is less than 100% can thereby be calculated from the engine torque curve of when the accelerator operation amount is 100%. However, the method for calculating the torque reduction amount that corresponds to the accelerator operation amount is not limited to one that uses a corrected engine rotation speed as described above. A plurality of torque reduction amount tables for each accelerator operation amount may be stored in the controller 10, and the torque reduction amount may be obtained from these tables.

In the embodiment described above, the torque reduction amount is set to zero in the tenth step S10 of the flowchart of FIG. 4. However, the torque reduction amount is not necessarily required to be zero.

The low-load conditions may be determined using different low-load conditions from those described above. The discrimination of the work phase may be carried out using a different work phase discrimination than that described above. The torque reduction amount may be calculated on the basis of torque reduction amount tables that are different from the torque reduction amount tables described above. For example, the speed stage of the transmission 26 may be included in the low-load conditions. The vehicle speed Vmax of the torque reduction amount table may be set to the maximum speed that corresponds to each speed stage.

The mode of the operation member is not limited to that exemplified above. For example, it is also possible to use sliding or dialed switches, and other operation members without limitation to levers and/or pedals.

In the work vehicle 1 according to the embodiment described above, the first controller 10*a* and the second controller 10*b* are separately provided, but these may be integrally provided. For example, the functions of first controller 10*a* and the second controller 10*b* may be implemented by a single computer. Conversely, the functions of the first controller 10*a* or the second controller 10*b* may be shared by a plurality of computers.

Figure 19:
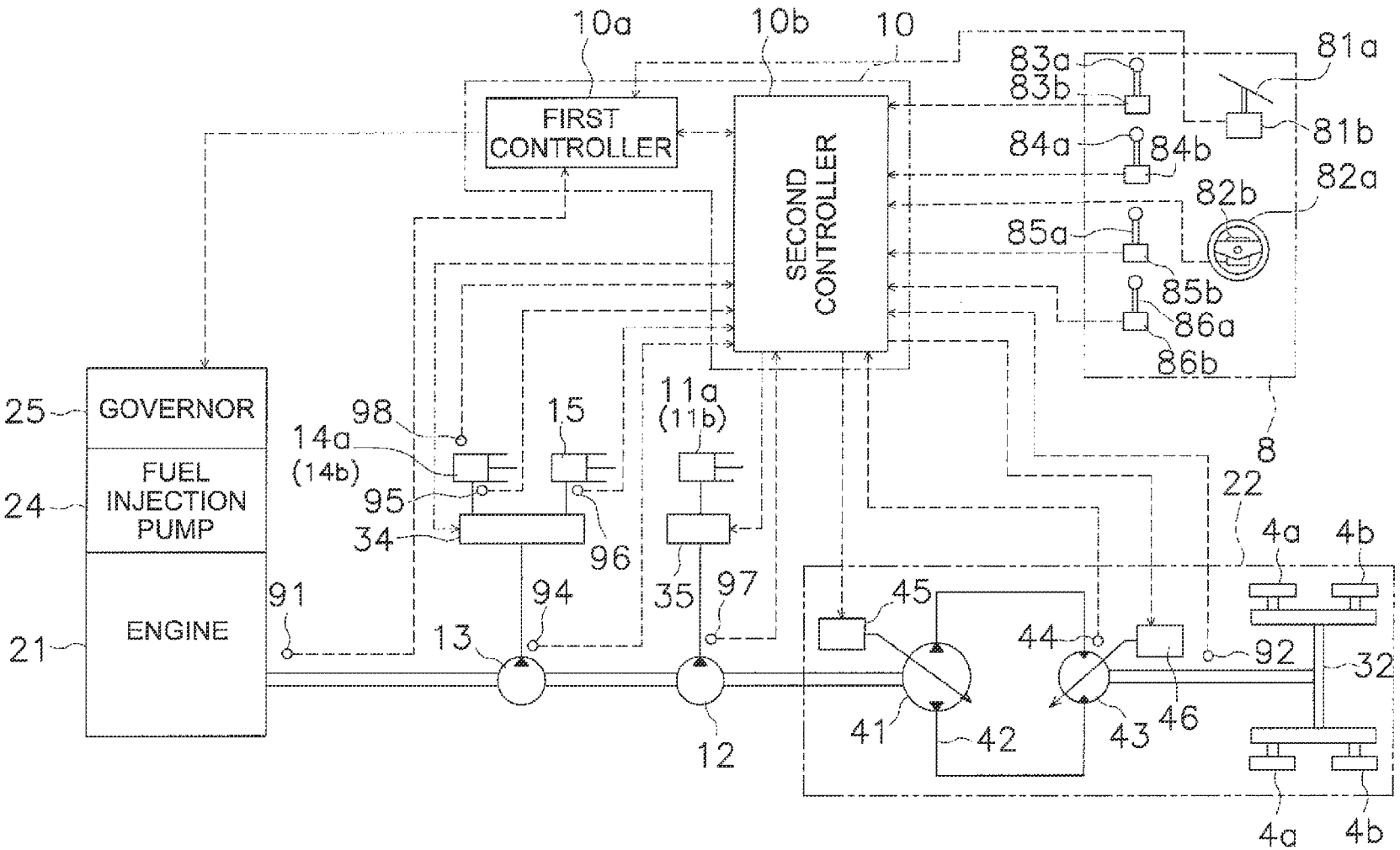
FIG. 19 is a block view showing an overview of the configuration of an HST work vehicle according to another embodiment of the present invention.

The work vehicle to which the present invention is applied is not limited to that described above. The present invention may be applied to a work vehicle other than a wheel loader described above. The present invention may also be applied to a work vehicle comprising a hydraulic static transmission (HST); or a hydraulic mechanical transmission (HMT) or another mechanical continuously variable transmission (CVT); or an electric continuously variable transmission. For example, in a work vehicle comprising a HST (hereinafter referred to as "HST work vehicle"), a hydraulic pump 41 for travel is driven by drive force from the engine 21, and the hydraulic fluid discharged from the hydraulic pump 41 for travel is fed to a hydraulic motor 43 via a travel circuit 42, as shown in FIG. 19. The hydraulic motor 43 is thereby driven, and the front wheels 4*a* and rear wheels 4*b* are driven by the rotational force of the hydraulic motor 43. The pressure of the hydraulic fluid fed to the hydraulic motor 43 (hereinafter referred to as "travel circuit hydraulic pressure") is detected by a travel circuit hydraulic pressure sensor 44. Also, a pump displacement control section 45 is provided for adjusting the tilt angle of the hydraulic pump 41 for travel using a control signal from the second controller 10*b*. The second controller 10*b* controls the pump displacement control section 45, whereby the displacement of the hydraulic pump 41 for travel can be electrically controlled. Also, a motor displacement control section 46 is provided for adjusting the tilt angle of the hydraulic motor 43 using a control signal from the second controller 10*b*. The second controller 10*b* controls the motor displacement control section 46, whereby the displacement of the hydraulic motor 43 can be electrically controlled. In FIG. 19, the same reference numerals are used for the same constituent elements of FIG. 2.

Figure 20:
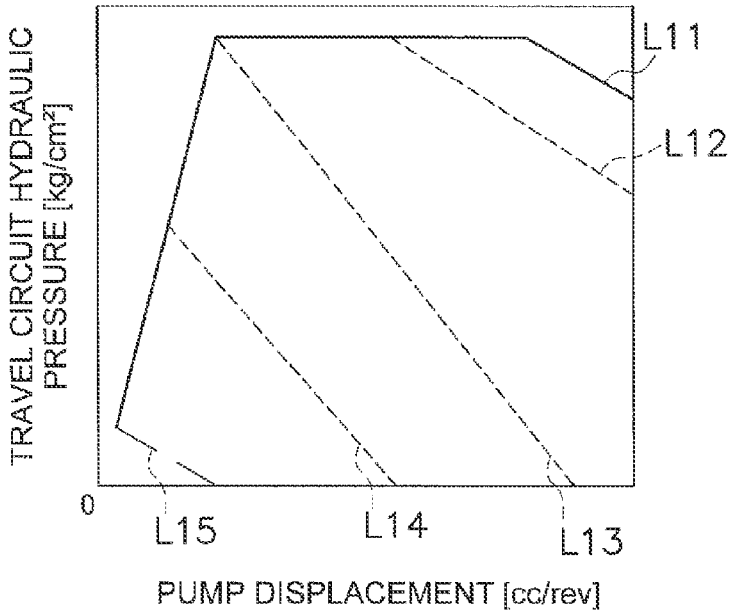
FIG. 20 is a view showing an example of the pump displacement/travel circuit hydraulic pressure characteristics in an HST work vehicle.

The second controller 10*b* processes output signals from the engine rotation speed sensor 91 and the travel circuit hydraulic pressure sensor 44, and outputs command signals for the pump displacement to the pump displacement control section 45. In this case, the second controller 10*b* refers to the pump displacement/travel circuit hydraulic pressure characteristics data stored in the second controller 10*b*, sets the pump displacement from the value of the engine rotation speed and the value of the travel circuit hydraulic pressure, and outputs to the pump displacement control section 45 the pump displacement command value that corresponds to the pump displacement thus set. FIG. 20 shows an example of the pump displacement/travel circuit hydraulic pressure characteristics data. The solid line L11 and the broken lines L12 to L15 in the drawing are lines showing the pump displacement and travel circuit hydraulic pressure characteristics data modified in accordance with the engine rotation speed. The pump displacement control section 45 modifies the tilt angle of the hydraulic pump 41 for travel on the basis of an inputted pump displacement command value. The pump displacement is thereby brought to a level that corresponds to the engine rotation speed.

Figure 21:
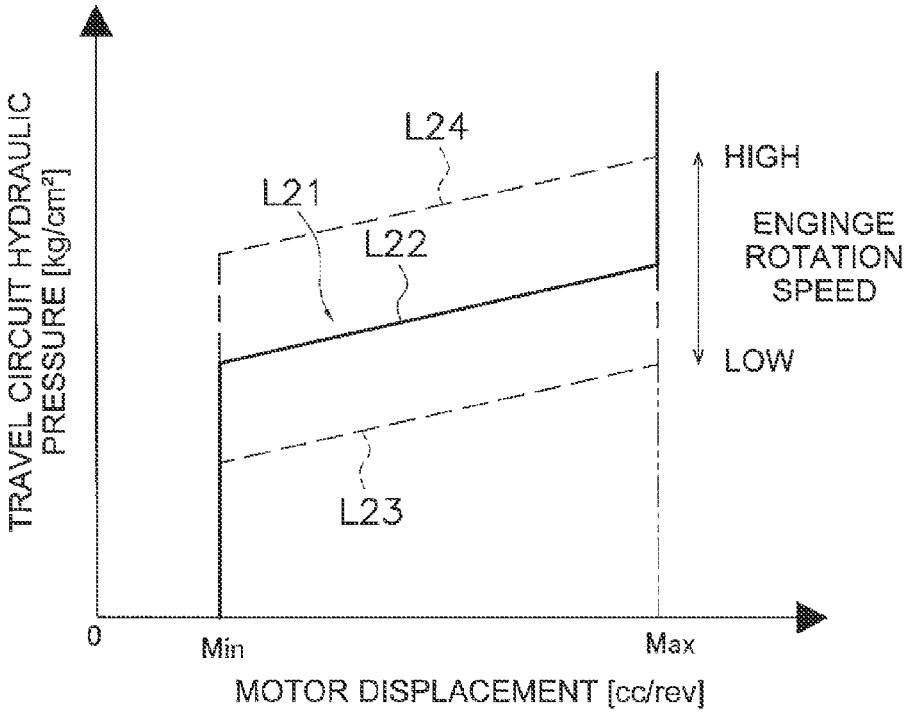
FIG. 21 is a view showing an example of the motor displacement/travel circuit hydraulic pressure characteristics in an HST work vehicle.

The second controller 10*b* processes output signals from the engine rotation speed sensor 91 and the travel circuit hydraulic pressure sensor 44, and outputs command signals for the motor displacement to the motor displacement control section 46. In this case, the second controller 10*b* refers to the motor displacement and travel circuit hydraulic pressure characteristics data stored in the second controller 10*b*, sets the motor displacement from the value of the engine rotation speed and the value of the travel circuit hydraulic pressure, and outputs to the motor displacement control section 46 the change command of the tilt angle that corresponds to the motor displacement thus set. FIG. 21 shows an example of the motor displacement and travel circuit hydraulic pressure characteristics data. The solid line L21 in the drawing is a line with an established tilt angle with respect to the travel circuit hydraulic pressure in a state in which the engine rotation speed is a value in a certain state. The tilt angle is at minimum (Min) until the travel circuit hydraulic pressure is equal to or less than a certain constant value. The tilt angle also gradually increases thereafter in accompaniment with the increase in travel circuit hydraulic pressure (the solid line sloped portion L22). The tilt angle reaches maximum (Max) and the tilt angle then stays at the maximum tilt angle Max even when the hydraulic pressure increases. The solid line sloped portion L22 noted above is set so as to rise and fall in accordance with the engine rotation speed. In other words, when the engine rotation speed is low, the tilt angle increases from a state in which the travel circuit hydraulic pressure is lower, and the travel circuit hydraulic pressure is controlled so as to reach the maximum tilt angle in a state in which the travel circuit hydraulic pressure is lower (see the broken line sloped portion L23 in the lower part of FIG. 21). Conversely, when the engine rotation speed is high, the minimum tilt angle Min is maintained until the travel circuit hydraulic pressure becomes higher, and the travel circuit hydraulic pressure is controlled so as to reach the maximum tilt angle Max in a state in which the travel circuit hydraulic pressure is higher (see the broken line sloped portion 124 in the upper part of FIG. 21).

The HST work vehicle comprises the same gear shift operation member 85*a* as that of the work vehicle 1 according to the embodiment described above. The second controller 10*b* stores the maximum vehicle speed that corresponds to each speed stage selected by the gear shift operation member 85*a*. The second controller 10*b* controls the motor displacement control section 46 so that the vehicle speed does not exceed the maximum speed for the selected speed stage. The same gear shift control as that of the work vehicle according to the embodiment described above is thereby performed. In this HST work vehicle, the same control of the engine 21 as that of the work vehicle according to the embodiment described above is performed by the first controller 10*a*.

The illustrated embodiment has an effect in which it is possible to inhibit a reduction in the ease of operation and to improve the effect of reduced fuel consumption. Accordingly, the illustrated embodiment is useful as a work vehicle and as a work vehicle control method.

The invention claimed is:

1. A work vehicle comprising:

an engine;

a travel device configured to cause the work vehicle to travel by drive force from the engine;

a work implement driven by drive force from the engine;

a first detector configured to detect engine rotation speed;

a second detector configured to detect a vehicle speed; and a controller configured to determine whether low-load conditions that show that the work vehicle is in a low-load state have been satisfied, wherein the controller is configured to control the engine so that an upper limit value of an output torque of the engine when the low-load conditions are satisfied is made less than when the low-load conditions are not satisfied, the controller is configured to vary a reduction amount of the upper limit value of the output torque of the engine when the low-load conditions are satisfied, in accordance with variation in the at least one of the vehicle speed, the vehicle acceleration, and the engine-rotation-speed acceleration detected by the second detector, and in accordance with variation in the engine rotation speed detected by the first detector, and when the vehicle speed is less than a first predetermined speed, and when the vehicle speed is greater than a second predetermined speed that is greater than the first predetermined speed, the controller is configured to reduce the reduction amount to be less than when the vehicle speed is equal to or greater than the first predetermined speed and equal to or less than the second predetermined speed.

2. The work vehicle according to claim 1, wherein the reduction amount varies in accordance with the low-load conditions.

3. The work vehicle according to claim 1, wherein the controller is configured to reduce the upper limit value of the output torque of the engine when the engine rotation speed is greater than a predetermined rotation speed; and the predetermined rotation speed varies in accordance with the low-load conditions.

4. The work vehicle according to claim 1, further comprising:

an accelerator operation member operated by an operator; and a third detector configured to detect an operation amount of the accelerator operation member, wherein the controller is configured to determine the reduction amount with consideration given to the operation amount of the accelerator operation member detected by the third detector.

5. The work vehicle according to claim 1, wherein when the vehicle speed is equal to or greater than a predetermined speed, the controller is configured to reduce the reduction amount to be less than when the vehicle speed is less than the predetermined speed.

6. The work vehicle according to claim 1, wherein the controller is configured to determine a work phase of the work vehicle based on an operating state of the travel device and the work implement, and determine whether the low-load conditions are satisfied based on the work phase.

7. The work vehicle according to claim 6, wherein the low-load conditions include that the work phase is an no-cargo state in which cargo is not loaded into the work implement.

8. The work vehicle according to claim 6, further comprising a forward/reverse switching operation member configured to perform switching between forward and reverse of the work vehicle, wherein the low-load conditions include that the work phase is a shuttle state in which a movement direction instructed by the forward/reverse switching operation member and a movement direction of the work vehicle are different.

9. The work vehicle according to claim 1, wherein the controller is configured to determine whether the work vehicle is traveling uphill, and in a case where the work vehicle is traveling uphill, the controller is configured to reduce the reduction amount.

10. A method for controlling a work vehicle including an engine, a travel device for causing the work vehicle to travel by drive force from the engine, and a work implement driven by drive force from the engine, the method comprising:

detecting engine rotation speed;

detecting at least one of vehicle speed, vehicle acceleration, and engine-rotation-speed acceleration;

determining whether low-load conditions indicating that the work vehicle is in a low-load state are satisfied;

controlling the engine so that an upper limit value of an output torque of the engine when the low-load conditions are satisfied is made less than when the low-load conditions are not satisfied;

varying the reduction amount of the upper limit value of the output torque of the engine when the low-load conditions are satisfied in accordance with variation in the at least one of the vehicle speed, the vehicle acceleration, and the engine-rotation-speed acceleration, and in accordance with variation in the engine rotation speed, and reducing the reduction amount to be less than when the vehicle speed is equal to or greater than a first predetermined speed and equal to or less than a second predetermined speed when the vehicle speed is less than the first predetermined speed and when the vehicle speed is greater than the second predetermined speed, the second predetermined speed being greater than the first predetermined speed.

* * * * *